US006148167A

United States Patent [19]

Komakine et al.

[11] Patent Number: 6,148,167

[45] Date of Patent: Nov. 14, 2000

[54] DEVELOPING APPARATUS WITH A DEVELOPING REGULATING MEMBER

[75] Inventors: Hiroshi Komakine, Toyonaka; Keizou Takeuchi, Hirakata; Kazumasa Hayashi, Kobe; Shigemitsu Tani, Hirakata; Takumi Kitano, Utsunomiya; Hiroyuki Suzuki, Kitakatsuragi-gun, all of Japan

[73] Assignee: Matsushita Electric Industrial Co., Ltd., Osaka-Fu, Japan

[21] Appl. No.: 09/234,542

[22] Filed: Jan. 21, 1999

[30] Foreign Application Priority Data

Jan. 21, 1998 [JP] Japan ..... 10-025073

[51] Int. Cl.[7] ..... G03G 15/08

[52] U.S. Cl. ..... 399/284; 399/279

[58] Field of Search ..... 399/274, 273, 399/283, 284, 252, 75; 430/100

[56] References Cited

U.S. PATENT DOCUMENTS

| | | | |
|---|---|---|---|
| 4,537,491 | 8/1985 | Komada et al. | 399/274 X |
| 4,990,959 | 2/1991 | Yamamuro et al. | 399/274 |
| 5,387,967 | 2/1995 | Brewington et al. | 399/273 X |
| 5,753,396 | 5/1998 | Nakamura et al. | 430/100 X |
| 5,768,656 | 6/1998 | Nagasue et al. | 399/75 |
| 5,863,329 | 1/1999 | Yamanouchi | 399/274 X |
| 5,937,253 | 8/1999 | Shimazaki et al. | 399/284 |

FOREIGN PATENT DOCUMENTS

| | | |
|---|---|---|
| 7-064391 | 3/1995 | Japan . |
| 9-171296 | 6/1997 | Japan . |
| 9-274378 | 10/1997 | Japan . |

*Primary Examiner*—Susan S. Y. Lee

*Attorney, Agent, or Firm*—Akin, Gump, Strauss, Hauer & Feld, L.L.P.

[57] ABSTRACT

In order to provide a developing apparatus in which the toner thin layer regulating capability and the toner charging capability can be enhanced by a developer regulating member of a simple structure, a development roller can be rotated with a small driving force, toner is prevented from adhering and development can be performed with high accuracy, the developer regulating member of the developing apparatus is provided with a surface constituting a step in a direction vertical to the direction of the rotation axis of the development roller, a pressed surface that is pressed against the development roller in the downstream side of the step and an opposed surface formed so as to be opposed to the development roller with a predetermined space therebetween in the upstream side of the step.

14 Claims, 20 Drawing Sheets

○ - Layer formation condition was excellent.
△ - Nonuniformity was found although layer was formed.
× - Hardly any layer was formed.

DEVELOPING APPARATUS WITH A DEVELOPING REGULATING MEMBER

BACKGROUND OF THE INVENTION

The present invention relates to a developing apparatus to be used in electrophotographic printers, copying machines, facsimile machines and the like, and a method of manufacturing the same In a conventional developing apparatus, toner serving as developer is supplied to a development roller which is rotating, and is then conveyed to a position where it is pressed by a developer regulating member. The toner conveyed to the developer regulating member while being held on the outer surface of the development roller is pressed by the developer regulating member into a thin layer of a predetermined thickness. At this time, the toner is charged, so that a charged toner layer is formed on the outer surface of the development roller. The toner of the charged toner layer is directly supplied to a photoconductor opposed to the development roller. The Japanese Published Unexamined Patent Application, Publication No. Hei 3-48876, discloses an example of the developing apparatus thus structured.

FIG. 20 is a cross-sectional view showing the structure of a relevant part of the developing apparatus disclosed in the Japanese Published Unexamined Patent Application, Publication No. Hei 3-48876. In the conventional developing apparatus shown in FIG. 20, in a toner space 105 containing toner serving as developer, toner is supplied to the outer surface of a development roller 107 by the rotation of a fan 106 in the direction of the arrow b, and is held thereon. The toner held on the development roller 107 is conveyed in the direction of the arrow a as the development roller 107 rotates. As shown in FIG. 20, a bent portion 108*a* in the vicinity of an end of a blade 108 serving as the developer regulating member is pressed against a pressed portion 109 of the development roller 107. The bent portion 108*a* is bent outwardly with respect to the development roller 107 so as to form an arc.

Consequently, the thickness of the layer of the toner held on the development roller 107 is regulated by the blade 108 at the pressed portion 109, and unnecessary toner is swept off. The toner regulated at the pressed portion 109 is charged by being in contact with the blade 108, so that a thin layer of the charged toner is formed on the outer surface of the development roller 107 having passed the pressed portion 109.

The toner thin layer thus formed on the development roller 107 is conveyed to a development area 111 opposed to a photoconductor 110, and a toner image is formed on an electrostatic latent image formed on the outer surface of the photoconductor 110.

In the conventional developing apparatus thus structured, the bent portion 108*a* formed in the vicinity of the end of the blade 108 serving as the developer regulating member is bent so as to form an arc. Since toner is held in a wedge-shaped space in the upstream side of the bent portion 108*a*, toner does not heap uniformly. Consequently, the blade 108 of the conventional developing apparatus is low in the capability of accurately forming the toner thin layer so as to have a predetermined thickness, and is low in the capability of sufficiently charging the toner of the thin layer. Moreover, in the conventional developing apparatus, since the toner on the outer surface of the development roller 107 is pressed by the arcing bent portion 108*a* of the blade 108, it is necessary that the pressure applied from the blade 108 to the development roller 107 be high, so that the development roller 107 requires a large driving force. Moreover, it is difficult to form a uniform layer since streaks are generated on the toner layer on the development roller 107 or some of the toner is scraped off from the toner layer

SUMMARY OF THE INVENTION

The present invention is made to solve the above-mentioned problems in the conventional developing apparatus, and an object thereof is to enhance a regulating capability for forming a uniform toner thin layer and a toner charging capability by a developer regulating member having a simple structure.

Another object of the present invention is to provide a developing apparatus in which the development roller can be rotated with a small driving force, toner is prevented from adhering to the developer regulating member and development can be performed with high accuracy, and a method of manufacturing the developing apparatus.

To achieve the above-mentioned objects, a developing apparatus of the present invention comprises: a development roller holding developer on a outer surface thereof, and rotating; and a developer regulating member being pressed against the outer surface of the development roller to regulate the developer on the development roller to a predetermined layer thickness. The developer regulating member has: a surface constituting a step in a rotation direction of the development roller; a pressed surface that is pressed against the development roller in a downstream side of the step; and an opposed surface that is opposed to the development roller with a predetermined space therebetween in an upstream side of the step.

According to the developing apparatus structured as described above, a toner reservoir is stably formed with a simple structure in an opposed portion in the upstream side of the step in the rotation direction of the development roller. Consequently, the pressure applied to the toner immediately before the layer is regulated is uniformized, so that a uniform toner layer is obtained stably. Moreover, according to the developing apparatus, the action of removing excessive one of the toner conveyed by the rotation of the development roller is enhanced.

Consequently, a uniform toner thin layer can be formed with a low pressure and the development roller is driven with a low torque.

In a developing apparatus according to another aspect of the present invention, it is preferable that the distance between the pressed surface constituted by the step and the opposed surface be 2 mm or smaller. According to a developing apparatus thus structured, by the step being 2 mm or smaller, the pressure applied to the toner immediately before the layer is regulated is further enhanced and the pressure applied to the toner is uniformized, so that a toner layer having a more uniform thickness is obtained stably.

In a developing apparatus according to another aspect of the present invention, when the distance between the pressed surface constituted by the step and the opposed surface is H and the length in the opposed surface along a circumference of the development roller is L, it is preferable that $H \leqq 0.7L$ and $H \leqq 2.0$ [mm]. According to the developing apparatus thus structured, a toner layer having a more uniform thickness is obtained with stability.

In a developing apparatus according to another aspect of the present invention, the developer regulating member may start to be pressed against the development roller at an edge formed by the surface constituting the step and the pressed surface. According to the developing apparatus thus structured, by pressing the developer regulating member against the development roller together with the edge, the action of removing excessive one of the toner conveyed by the rotation of the development roller is further enhanced. Consequently, the developer regulating member can form a toner thin layer with a lower pressure and the driving torque of the development roller is further reduced. Moreover, since the developer regulating member does not press the toner against the development roller with a very high pressure when the layer is regulated, toner cohesion does not easily occur, so that the granularity improves. Consequently, excellent images are obtained and toner adhesion to the development regulating member over time does not easily occur. Further, the stress on the toner is low and toner deterioration is small.

In a developing apparatus according to another aspect of the present invention, it is preferable that the surface roughness Ra (average roughness at the center line) of the pressed surface of the developer regulating member be 0.1 $\mu$m or more. According to the developing apparatus thus structured, the action of stirring the toner is enhanced when the toner passes the portion where the developer regulating member is pressed against the development roller, so that the toner charging capability is increased. Consequently, according to the developing apparatus of the present invention, even when the toner is deteriorated due to use over time, the toner can be charged with stability, so that sharp images without any background development are obtained with stability.

In a developing apparatus according to another aspect of the present invention, the developer regulating member may have a second opposed surface having a second step formed in the downstream side of the pressed surface, and being opposed to the development roller with a predetermined space therebetween. With this structure, the developing apparatus of the present invention is capable of forming uniform images with stability over time.

A developing apparatus according to another aspect of the present invention comprises: a development roller holding developer on a outer surface thereof, and rotating; and a developer regulating member being pressed against the outer surface of the development roller to regulate the developer on the development roller to a predetermined layer thickness The developer regulating member comprises a first plate and a second plate overlapping each other, and has a step in a rotation direction of the development roller. The first plate has a pressed surface that is pressed against the development roller in a downstream side of the step. The second plate has an opposed surface that is opposed to the development roller with a predetermined space therebetween in an upstream side of the step.

According to the developing apparatus thus structured, the step can be formed in the developer regulating member with the simple and low-cost structure comprising two plates overlapping each other, and since the developer regulating member has a plate form, it can be uniformly pressed against the development roller. The toner reservoir is stably formed in the opposed portion in the upstream side of the step in the rotation direction of the development roller. Consequently, the pressure applied to the toner immediately before the layer is regulated is uniformized, so that a uniform toner thin layer is obtained with stability. Moreover, by pressing the developer regulating member against the development roller at the pressed surface of the first plate including the edge, the action of removing excessive one of the toner conveyed by the rotation of the development roller is enhanced. Consequently, the toner thin layer can be formed with a low pressure and the driving torque of the development roller is reduced. Further, since the developer regulating member does not press the toner against the development roller with a very high pressure when the layer is regulated, toner cohesion does not easily occur, so that images with excellent granularity are obtained and toner adhesion to the developer regulating member does not easily occur Further, with this structure, in the above-described developing apparatus, the stress on the toner is low and toner deterioration is small.

In a developing apparatus according to another aspect of the present invention, it is preferable that the thickness of the first plate be 2 mm or smaller According to the developing apparatus thus structured, the pressure applied to the toner immediately before the layer is regulated is further increased and the pressure applied to the toner is uniformized, so that a more uniform toner layer is obtained with stability.

In a developing apparatus according to another aspect of the present invention, it is preferable that the surface roughness Ra of the pressed surface of the first plate be 0.1 $\mu$m or more. According to the developing apparatus thus structured, the action of stirring the toner is enhanced when the toner passes the portion where the developer regulating member is pressed against the development roller, so that the toner charging capability is increased. Consequently, even when the toner is deteriorated due to change over time, the toner can be charged with stability, so that sharp images without any background development are obtained with stability.

In a developing apparatus according to another aspect of the present invention, the first plate may be made of a conductive material. According to the developing apparatus thus structured, the charging of the toner is uniformized when the toner passes the nip at the portion where the developer regulating member is pressed against the development roller, so that uniform images without any nonuniformity also in halftone are obtained.

In a developing apparatus according to another aspect of the present invention, the first plate may be made of a conductive material, and voltage generating means may be provided for applying a DC voltage and an AC voltage to the first plate. According to the developing apparatus thus structured, the movement of charges from the first plate or the development roller to the toner is prompted by the action of an electric field, so that the toner charging capability is increased. Consequently, even when the toner is deteriorated due to change over time, the toner can be charged with stability, so that sharp images without any background development are obtained with stability. Particularly, by applying an AC voltage to the first plate, the toner makes a vigorous reciprocating motion between the first plate and the development roller after the toner has passed the portion where the first plate is pressed against the development roller, so that an extremely uniform toner thin layer is obtained.

In a developing apparatus according to another aspect of the present invention, the first plate may be made of an elastic material. According to the developing apparatus thus structured, the width of the portion where the first plate is pressed against the development roller is increased, so that the toner is more frequently in contact with the first plate and the development roller. This increases the toner charging capability. Consequently, even when the toner is deteriorated due to change over time, the toner can be charged with stability, so that sharp images without any background development are obtained with stability.

In a developing apparatus according to another aspect of the present invention, the second plate may be made of a conductive material, and voltage generating means may be provided for applying a DC voltage and an AC voltage to the second plate. According to the developing apparatus thus structured, the movement of charges from the first plate, the second plate and the development roller to the toner is prompted by the action of an electric field, so that the toner charging capability is increased. Consequently, even when the toner is deteriorated due to change over time, the toner can be charged with stability, so that sharp images without any background development are obtained with stability. Particularly, by applying an AC voltage to the second plate, the toner is stirred between the second plate and the development roller in the toner reservoir immediately before the layer is formed, and the toner makes a vigorous reciprocating motion between the first plate and the development roller after the toner has passed the portion where the first plate is pressed against the development roller. Consequently, an extremely uniform toner thin layer is obtained.

In a developing apparatus according to another aspect of the present invention, the second plate may be made of an elastic material. According to the developing apparatus thus structured, variation in the pressure applied to the toner in the toner reservoir immediately before the layer is formed is reduced by the elasticity of the second plate. Consequently, variation in the amount of toner conveyed by the rotation of the development roller is absorbed, so that an image hysteresis phenomenon is reduced.

A developing apparatus according to another aspect of the present invention comprises: a development roller holding developer on a outer surface thereof, and rotating; and a developer regulating member being pressed against the outer surface of the development roller to regulate the developer on the development roller to a predetermined layer thickness. The developer regulating member comprises a first plate and a second plate overlapping each other, and has a step in a rotation direction of the development roller. An end of at least one of the first plate and the second plate is supported in a downstream side in the rotation direction of the development roller. The first plate has a pressed surface that is pressed against the development roller in the downstream side of the step. The second plate protrudes from the first plate in an upstream side of the step, and has an opposed surface that is opposed to the development roller with a predetermined space therebetween.

According to the developing apparatus thus structured, the step can be formed in the developer regulating member with the simple and low-cost structure comprising two plates overlapping each other, and since the developer regulating member has a plate form, it can be uniformly pressed against the development roller. The toner reservoir is stably formed in the opposed portion in the upstream side of the step in the rotation direction of the development roller. Consequently, the pressure applied to the toner immediately before the layer is regulated is uniformized, so that a uniform toner thin layer is obtained with stability. Moreover, since there is a sufficient space in the further upstream side of the opposed portion in the upstream side in the rotation direction of the development roller, not all of the pressure applied to the toner conveyed by the rotation of the development roller is directed to the pressed portion but some of the pressure is dissipated. Consequently, the pressure applied to the toner in the toner reservoir is never excessive, so that a toner thin layer being stable over time is obtained.

Moreover, by pressing the developer regulating member against the development roller at the pressed surface of the first plate including the edge, the action of removing excessive one of the toner conveyed by the rotation of the development roller is enhanced. Consequently, the toner thin layer can be formed with a low pressure and the driving torque of the development roller is reduced. Further, since the developer regulating member does not press the toner against the development roller with a very high pressure when the layer is regulated, toner cohesion does not easily occur, so that images with excellent granularity are obtained and toner adhesion to the developer regulating member does not easily occur. Further, with this structure, in the above-described developing apparatus, the stress on the toner is low and toner deterioration is small.

In a developing apparatus according to another aspect of the present invention, the length of the portion of the second plate protruding from the first plate in the upstream side in the rotation direction of the development roller may be larger than the thickness of the first plate. According to the developing apparatus thus structured, the toner reservoir is more stably formed in the opposed portion in the upstream side of the step in the rotation direction of the development roller. Consequently, the pressure applied to the toner immediately before the layer is regulated is uniformized, so that a uniform toner thin layer is obtained with stability.

A developing apparatus according to another aspect of the present invention comprises: a development roller holding developer on a outer surface thereof, and rotating; and a developer regulating member being pressed against the outer surface of the development roller to regulate the developer on the development roller to a predetermined layer thickness. The developer regulating member has an elastic member made of an elastic material, and a step forming member being pressed against the development roller by the elasticity of the elastic member, and having a step in a rotation direction of the development roller. The step forming member has a pressed surface that is pressed against the development roller in a downstream side of the step, and an opposed surface that is opposed to the development roller with a predetermined space therebetween in an upstream side of the step According to the developing apparatus thus structured, because of the configuration of the step forming member, the step can be formed without restraint Moreover, since the toner reservoir is stably formed in the opposed portion in the upstream side of the step in the rotation direction of the development roller, the pressure applied to the toner immediately before the layer is regulated is uniformized, so that a uniform toner thin layer is obtained with stability. Moreover, by pressing the developer regulating member against the development roller at the pressed surface including the edge constituted by the step of the step forming member, the action of removing excessive one of the toner conveyed by the rotation of the development roller is enhanced. Consequently, the developer regulating member can form a toner thin layer with a low pressure and the development roller can be driven with a low torque.

Since the developer regulating member does not press the toner against the development roller with a very high pressure when the layer is regulated, toner cohesion does not easily occur, so that images with excellent granularity are obtained and toner adhesion to the developer regulating member does not easily occur. Further, in the developing apparatus structured as described above, the stress on the toner is low and toner deterioration is small.

In a developing apparatus according to another aspect of the present invention, the step forming member may be made of an elastic material. According to the developing apparatus thus structured, the width of the portion where the step forming member is pressed against the development roller is increased, so that the toner is more frequently in contact with the step forming member and the development roller. This increases the toner charging capability. Consequently, even when the toner is deteriorated due to change over time, the toner can be charged with stability, so that sharp images without any background development are obtained with stability.

In a developing apparatus according to another aspect of the present invention, the elastic member and the step forming member may be integral with each other. According to the developing apparatus thus structured, the developer regulating member can be formed with high accuracy at low cost, and a more uniform toner thin layer is obtained.

A developing apparatus according to another aspect of the present invention comprises: a development roller holding developer on a outer surface thereof, and rotating; and a developer regulating member being pressed against the outer surface of the development roller to regulate the developer on the development roller to a predetermined layer thickness. The developer regulating member is formed by bending one plate, and has: a surface constituting a step in a rotation direction of the development roller; a pressed surface that is pressed against the development roller in a downstream side of the step; and an opposed surface that is opposed to the development roller with a predetermined space therebetween in an upstream side of the step.

According to the developing apparatus thus structured, the step can be formed in the developer regulating member with the simple and low-cost structure, and since the developer regulating member has a plate form, it can be uniformly pressed against the development roller Moreover, in the developing apparatus of this structure, since the toner reservoir is stably formed in the opposed portion in the upstream side of the step in the rotation direction of the development roller, the pressure applied to the toner immediately before the layer is regulated is uniformized, so that a uniform toner thin layer is obtained with stability.

In the developing apparatus, by pressing the developer regulating member against the development roller at the pressed surface including the edge constituted by the step, the action of removing excessive one of the toner conveyed by the rotation of the development roller is enhanced. Consequently, the developer regulating member can form a toner thin layer with a low pressure and the development roller can be driven with a low torque. Since the developer regulating member does not press the toner against the development roller with a very high pressure when the layer is regulated, toner cohesion does not easily occur, so that images with excellent granularity are obtained and toner adhesion to the developer regulating member does not easily occur. Further, in the developing apparatus structured as described above, the stress on the toner is low and toner deterioration is small.

A developing apparatus according to another aspect of the present invention comprises: a development roller holding developer on a outer surface thereof, and rotating; and a developer regulating member being pressed against the outer surface of the development roller to regulate the developer on the development roller to a predetermined layer thickness. The developer regulating member has an elastic member made of an elastic material, and a wire fixed to the elastic member and pressed against the development roller by the elasticity of the elastic member. At least a part of the elastic member has an opposed surface that is opposed to the development roller with a predetermined space therebetween in an upstream side of the wire in a rotation direction of the development roller.

According to the developing apparatus thus structured, the step can be formed with the simple and low-cost structure, and the toner reservoir is stably formed in the opposed portion in the upstream side of the wire in the rotation direction of the development roller. Consequently, the pressure applied to the toner immediately before the layer is regulated is uniformized, so that a uniform toner thin layer is obtained with stability.

According to the developing apparatus thus structured, by pressing the wire against the development roller, the action of removing excessive one of the toner conveyed by the rotation of the development roller is enhanced. Consequently, the developer regulating member can form a toner thin layer with a low pressure and the development roller can be driven with a low torque. Since the developer regulating member does not press the toner against the development roller with a very high pressure when the layer is regulated, toner cohesion does not easily occur, so that images with excellent granularity are obtained and toner adhesion to the developer regulating member does not easily occur. In the developing apparatus, the stress on the toner is low and toner deterioration is small.

In a developing apparatus according to another aspect of the present invention, it is preferable that the cross-sectional configuration of the wire be substantially circular and that the radius of the wire be 0.1 to 0.5 mm. According to the developing apparatus thus structured, the action of removing excessive one of the toner conveyed by the rotation of the development roller is further enhanced. Consequently, the developer regulating member can form a toner thin layer with a low pressure and the development roller can be driven with a low torque. Since the developer regulating member does not press the toner against the development roller with a very high pressure when the layer is regulated, toner cohesion does not easily occur, so that images with excellent granularity are obtained and toner adhesion to the developer regulating member does not easily occur. In the developing apparatus, the stress on the toner is low and toner deterioration is small.

In a developing apparatus according to another aspect of the present invention, it is preferable that the surface roughness Ra of the wire be 0.1 $\mu$m or more. According to the developing apparatus thus structured, the action of stirring the toner is enhanced when the toner passes the portion where the wire is pressed against the development roller, so that the toner charging capability is increased. Consequently, even when the toner is deteriorated due to change over time, the toner can be charged with stability, so that sharp images without any background development are obtained with stability.

In a developing apparatus according to another aspect of the present invention, it is preferable that the surface material of the development roller be an elastic material. According to the developing apparatus thus structured, a stable wide nip can be formed between the developer regulating member and the development roller, so that the toner is more frequently in contact with the developer regulating member and the development roller. This increases the toner charging capability. Consequently, even when the toner is deteriorated due to change over time, the toner can be charged with stability, so that sharp images without any background development are obtained with stability. Moreover, since the developer regulating member can stably charge the toner with a low pressure, the driving torque of the development roller is reduced, so that jitter is significantly reduced.

In a developing apparatus according to another aspect of the present invention, the surface material of the development roller may be silicon. According to the developing apparatus thus structured, since the surface of the development roller is uniformly scraped by the edge constituted by the step of the layer forming member, the surface of the development roller is not filmed with toner and the toner can be charged with stability even after printing of a multiplicity of sheets, so that sharp images without any background development are obtained with stability.

In a developing apparatus according to another aspect of the present invention, the surface material of the development roller may be urethane. According to the developing apparatus thus structured, even when the surface of the development roller is filmed with toner, the toner is uniformly scraped off by the edge constituted by the step of the developer regulating member. Consequently, no toner film is formed on the surface of the development roller and the toner can be charged with stability even after printing of a multiplicity of sheets, so that sharp images without any background development are obtained with stability. Moreover, since urethane has high wear resistance and is not easily scraped off, the life of the development roller is further increased.

In a developing apparatus according to another aspect of the present invention, non-magnetic toner may be used as the developer. According to the developing apparatus thus structured, the edge constituted by the step of the developer regulating member and the pressed portion in the vicinity of the step are not flawed due to change over time, so that uniform images where no streaks are generated even after printing of a multiplicity of sheets are obtained.

In a method of manufacturing a developing apparatus according to the present invention, in a developing apparatus comprising: a development roller holding developer on a outer surface thereof, and rotating; and a developer regulating member being pressed against the outer surface of the development roller to regulate the developer on the development roller to a predetermined layer thickness, the developer regulating member having: a surface constituting a step in a rotation direction of the development roller; a pressed surface that is pressed against the development roller in a downstream side of the step; and an opposed surface that is opposed to the development roller with a predetermined space therebetween in an upstream side of the step is cut out from one plate.

According to the method of manufacturing a developing apparatus, the step can be easily formed with high accuracy at low cost. Moreover, since the developer regulating member has a plate form and is integrally formed, it can be uniformly pressed against the development roller.

In a developing apparatus manufactured by the above-described method, the toner reservoir is stably formed in the opposed portion in the upstream side of the step in the rotation direction of the development roller. Consequently, the pressure applied to the toner immediately before the layer is regulated is uniformized, so that a uniform toner thin layer is obtained with stability. Moreover, in the developing apparatus manufactured by the above-described method, by pressing the developer regulating member against the development roller at the pressed surface including the edge constituted by the step, the action of removing excessive one of the toner conveyed by the rotation of the development roller is enhanced. Consequently, the developer regulating member can form a toner thin layer with a low pressure and the development roller can be driven with a low torque. Since the developer regulating member does not press the toner against the development roller with a very high pressure when the layer is regulated, toner cohesion does not easily occur, so that images with excellent granularity are obtained and toner adhesion to the developer regulating member does not easily occur. In the developing apparatus structured as described above, the stress on the toner is low and toner deterioration is small.

In a method of manufacturing a developing apparatus according to another aspect of the present invention, the developer regulating member may be formed by cutting one plate by chemical processing. According to the method of manufacturing a developing apparatus, a step with high accuracy can be stably formed at lower cost by chemical processing such as etching.

In a method of manufacturing a developing apparatus according to another aspect of the present invention, the developer regulating member may be formed by cutting one plate by machining. According to the method of manufacturing a developing apparatus, a step with high accuracy can be formed by machining.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

Hereinafter, preferred embodiments of a developing apparatus and a method of manufacturing the same according to the present invention will be described with reference to the accompanying drawings.

First Embodiment

Figure 1:
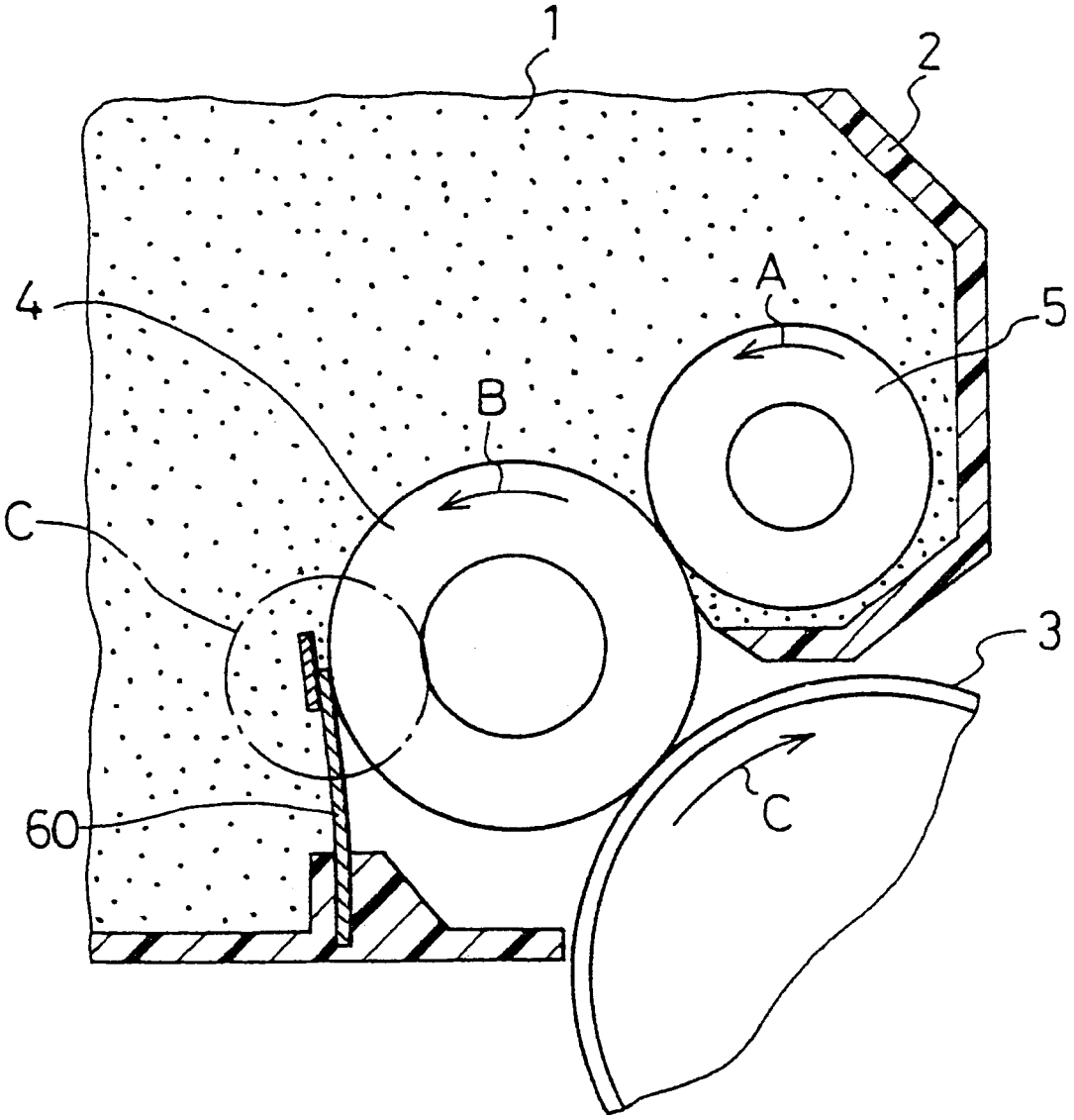
FIG. 1 is a cross-sectional view showing a relevant part of a developing apparatus according to a first embodiment of the present invention.

A developing apparatus according to a first embodiment of the present invention will be described with reference to the accompanying drawings. FIG. 1 is a cross-sectional view showing a relevant part of the developing apparatus of the first embodiment of the present invention.

In the developing apparatus of the first embodiment shown in FIG. 1, non-magnetic single-component black toner 1 serving as developer is contained in a development hopper 2, and is supplied to a development roller 4 by the rotation of a supply roller 5 in the direction of the arrow A. The supply roller 5 has a cylindrical shape whose outer surface is made of a urethane foam material. The development roller 4 used in the first embodiment has a cylindrical shape with a diameter of 18 mm, and silicone rubber of low hardness (a JIS-A hardness of 43 degrees) with a thickness of 4 mm is bonded to the outer surface thereof. Specifications of the development roller 4 are such that the electrical resistance is $10^4\Omega$ and the surface roughness Ra (the average roughness at the center line) is 0.4 $\mu$m. The electrical resistance is obtained in the following manner: The development roller 4 is placed on a chrome-plated iron plate, and under a condition where the development roller 4 presses on the iron plate with its deadweight, a voltage of 5 V is applied between the shaft of the development roller 4 and the plate, and the electrical resistance is obtained from the current value after ten seconds. In the first embodiment, the development roller 4 rotates in the direction of the arrow B at a circumferential velocity of 170 mm/s.

As shown in FIG. 1, an organic photoconductor 3 having a cylindrical shape with a diameter of 30 mm and disposed so as to be opposed to the development roller 4 is a multi-layer organic photoconductor with phthalocyanine as the base. The organic photoconductor 3 of the first embodiment rotates in the direction of the arrow C at a circumferential velocity of 105 mm/s.

In the vicinity of the development roller 4 is provided a blade 60 serving as a developer regulating member for regulating the thickness of the layer of the toner 1 on the development roller 4. The blade 60 is fixed to a wall of the development hopper 2 and is at the same potential as the development roller 4.

Figure 2:
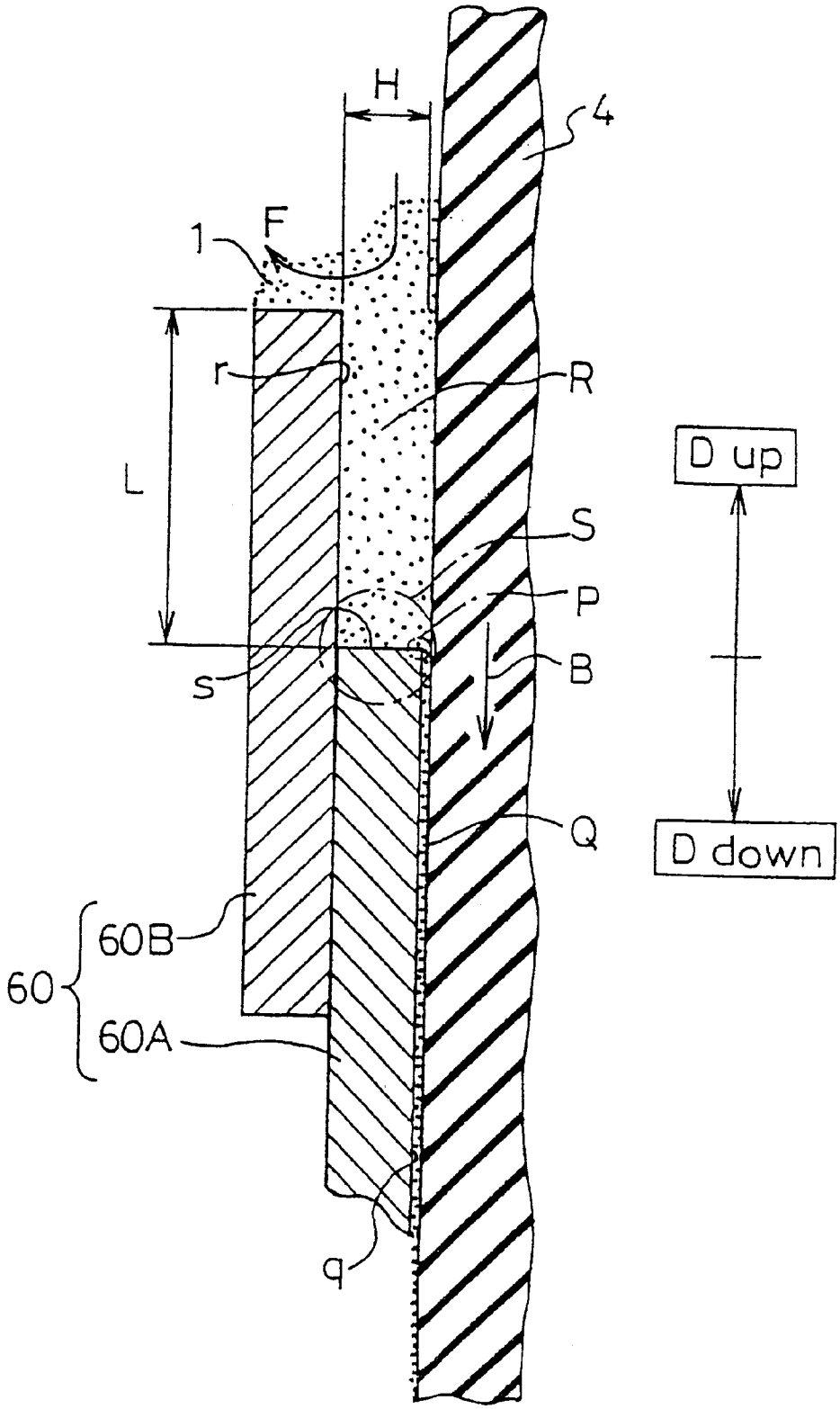
FIG. 2 is an enlarged cross-sectional view showing a portion where a blade is pressed against a development roller and a portion therearound in the developing apparatus of the first embodiment.

FIG. 2 is an enlarged detail view showing a portion where the blade 60 serving as the developer regulating member is pressed against the development roller 4 (the portion shown in C in FIG. 1).

As shown in FIG. 2, the blade 60 comprises a first blade plate 60A and a second blade plate 60B bonded together so as to overlap each other. An end of the second blade plate 60B protrudes from an end of the first blade plate 60A by a distance L. In the first embodiment, the first blade plate 60A is made of a plate of stainless steel (SUS304) with a thickness of 150 $\mu$m, and the second blade plate 60B is made of a plate of stainless steel (SUS304) with a thickness of 150 $\mu$m. In the blade 60, the second blade plate 60B is bonded so as to protrude from the end of the first blade plate 60A, so that a step S is formed. The height H of the step S is 150 $\mu$m, which is the thickness of the first blade plate 60A. A surface s constituting the step S is disposed so as to be substantially vertical to the pressed surface of the development roller 4. The surface s constituting the step S and the pressed surface of the development roller 4 are not necessarily vertical to each other Excellent results were obtained when the surfaces were disposed so as to form an angle of 45 to 135 degrees therebetween.

In the first embodiment, the distance L by which the second blade plate 60B protrudes from the first blade plate 60A is 1.0 to 2.0 mm.

When the toner 1 adhering to the development roller 4 is regulated to a predetermined layer thickness by the blade 60 serving as the developer regulating member, the toner 1 starts to be pressed by the development roller 4 in the vicinity of an edge P of the first blade plate 60A where the plate 60A starts to be in contact with the development roller 4. In the upstream side (D up) of the step S in the rotation direction of the development roller 4 (the direction of the arrow B in FIG. 2), the second blade plate 60B and the development roller 4 are opposed to each other with a predetermined space therebetween. The length in the rotation direction of the development roller 4 at an opposed surface r of the second blade plate 60B is represented by the protrusion distance L, which is 1.0 to 2.0 mm in the first embodiment.

In the downstream side (D down) of the step S in the rotation direction of the development roller 4 (the direction of the arrow B), the first blade plate 60A is pressed against the development roller 4. In the first embodiment, the blade 60 is pressed against the development roller 4 at a pressure of approximately 24 gf/cm.

The toner 1 used in the developing apparatus of the first embodiment is non-magnetic single-component black toner formed in the following manner: Five percent by weight of carbon pigment serving as colorant and three percent by weight of a charge control material are kneaded and dispersed in 92 percent by weight of polyester resin. This is crushed and classified with respect to particle size. Then, to 99.5 percent by weight of the obtained non-magnetic toner base particles with an average diameter of 8.5 $\mu$m, 0.5 percent by weight of hydrophobic silica serving as a surface reformer is externally added (mixed).

The operation of the developing apparatus of the first embodiment thus structured will be described with reference to FIGS. 1 and 2.

The toner 1 in the development hopper 2 is supplied to the surface of the development roller 4 by the rotation of the supply roller 5 in the direction of the arrow A. The supplied toner 1 is conveyed to the position of pressing by the blade 60 by the rotation of the development roller 4 in the direction of the arrow B. The toner 1 conveyed to the position of the development roller 4 pressed by the blade 60 is regulated to a desired layer thickness by the blade 60. By the blade 60, a uniform toner thin layer is formed on the development roller 4.

The organic photoconductor 3 opposed to the development roller 4 is charged to −500 V by a charger (not shown). By irradiating the organic photoconductor 3 with an exposure signal (not shown) comprising laser, an electrostatic latent image is formed. When an electrostatic latent image is formed in this manner, in the first embodiment, the total exposure potential of the organic photoconductor 3 is −60 V. To the development roller 4, a DC voltage of −150 V is applied by a developing bias source (not shown).

In the developing apparatus of the first embodiment, the development roller 4 carrying the thin layer of the non-magnetic single-component toner 1 is in contact with the organic photoconductor 3 moving substantially in the same direction as the development roller at the opposed portion. Therefore, a toner image in which only the image part is negative-positive reversed is formed on the organic photoconductor 3.

Observing the layer regulation condition in the vicinity of the portion where the development roller 4 is pressed by the blade 60, in the upstream side (D up), in the rotation direction of the development roller 4, of the portion where the second blade plate 60B and the development roller 4 are opposed to each other, much of the toner conveyed by the development roller 4 moved in the direction of the arrow F. Thus, observing the vicinity of the pressed portion of the regulated toner layer with the blade 60 being detached, the opposed portion R where the second blade plate 60B and the development roller 4 were opposed to each other in the upstream side (D up) of the step S was filled with the toner 1.

In a pressed portion Q in the downstream side (D down) of the step S, a toner layer was uniformly formed with a width of approximately 1.0 mm from the edge P of the first blade plate 60A. It is conjectured that the toner 1 is pressed by the development roller 4 and the blade 60 in the pressed portion Q.

The images obtained by use of the toner layer thus formed were always stable in maximum image density, and even after 10,000 sheets were continuously printed, high-quality images without any background development were obtained with stability. Moreover, the toner layer on the development roller 4 had an extremely uniform thickness; no streaks due to the toner adhesion are generated and a toner thin layer being entirely uniform was formed.

Observing the toner layer after continuous printing with the blade 60 being detached, there was not any toner scraping in the portion pressed by the edge P of the first blade plate 60A or in the portion Q pressed by the development roller 4 and the first blade plate 60A.

Figure 3:
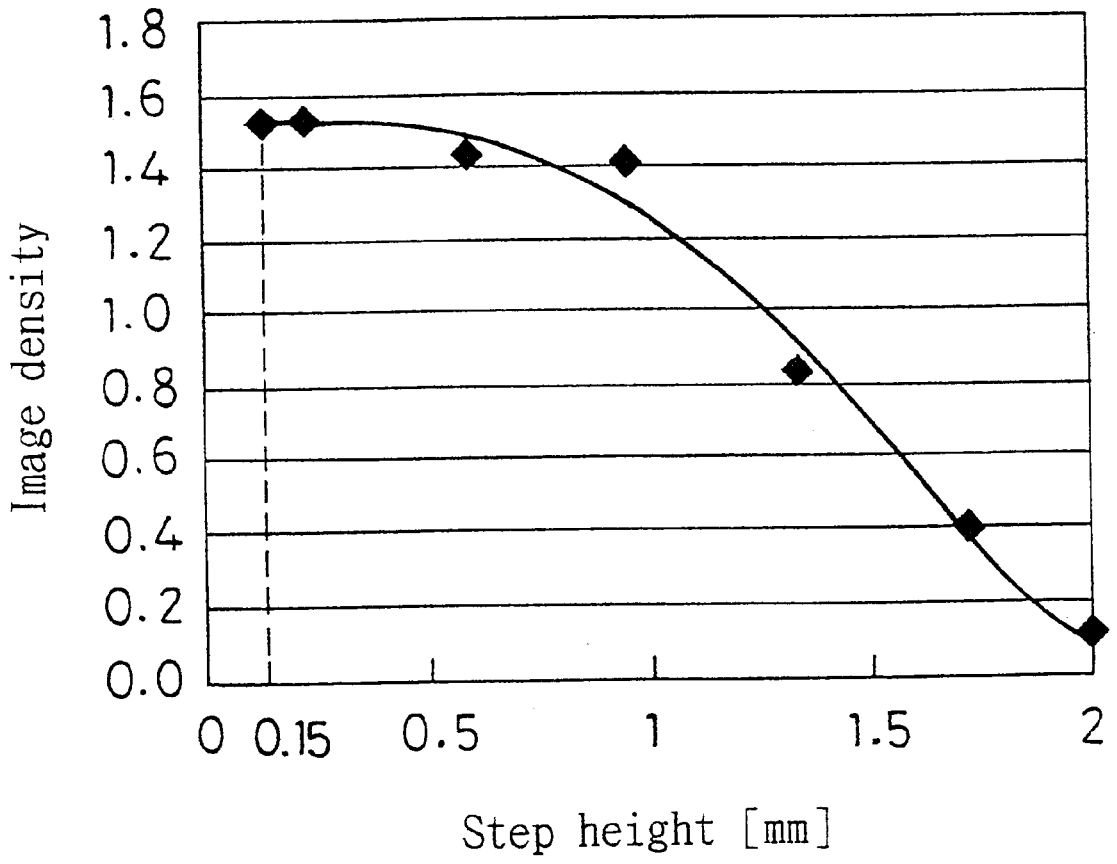
FIG. 3 is a graph showing the relationship between the image density and a step S in the blade of the developing apparatus of the first embodiment of the present invention.

FIG. 3 shows results of an experiment for investigating the relationship between the step S and the image density by use of various types of blades in the developing apparatus of the first embodiment. In this experiment, the blades were pressed against the development roller at the same pressure. While the thickness of the first blade plate 60A, that is, the height H of the step S is 150 $\mu$m in the developing apparatus of the first embodiment, as shown in FIG. 3, a certain degree of image density is obtained when the height H of the step S is 2.0 mm or smaller in the developing apparatus of the present invention. It is understood that when the height H of the step S is 0.5 mm or smaller, the image density is constant at a high value and a uniform toner thin layer is surely formed.

While the amount of protrusion of the second blade plate 60B from the first blade plate 60A, that is, the length L of the opposed portion R is 1 to 2 mm, in the developing apparatus of the present invention, it is necessary for the amount L of protrusion of the second blade plate 60B from the first blade plate 60A only to be 0.2 mm or larger. The formed toner layer was particularly preferable when the protrusion amount L was between 0.5 to 3 mm.

According to an experiment by the inventors, when the thickness H of the first blade plate 60A was larger than 2 mm or when the amount L of protrusion of the second blade plate 60B from the first blade plate 60A was smaller than 0.2 mm, the pressure applied to the toner 1 was low in the toner reservoir in the opposed portion R where the second blade plate 60B and the development roller 4 were opposed to each other. Consequently, the toner thin layer was extremely thin and nonuniform.

Moreover, even when the amount L of protrusion of the second blade plate 60B from the first blade plate 60A was within the above-mentioned appropriate range (0.1 mm or larger), when the thickness H of the first blade plate 60A was larger than the amount L of protrusion of the second blade plate 60B from the first blade plate 60A, the pressure applied to the toner 1 in the toner reservoir in the opposed portion R where the second blade plate 60B and the development roller 4 were opposed to each other was low according to the toner 1. Consequently, the toner thin layer was extremely thin and nonuniform.

Next, the relationship between the height H of the step S and the amount L of protrusion of the second blade plate 60B from the first blade plate 60A will be described. To investigate the relationship, the inventors carried out an experiment for examining the condition of toner layer formation under the blade 60 when the height H of the step S and the protrusion amount L took specific values. With respect to the toner used in the experiment, the volume average particle diameter of the toner was 9.1 μm and the static-bulk density of the toner was 0.37 g/cm$^2$. The blade 60 was made of phosphor bronze. The surface roughness (Ra) of the blade was 0.12 μm. The blade pressure was 24 gf/cm.

Figure 4:
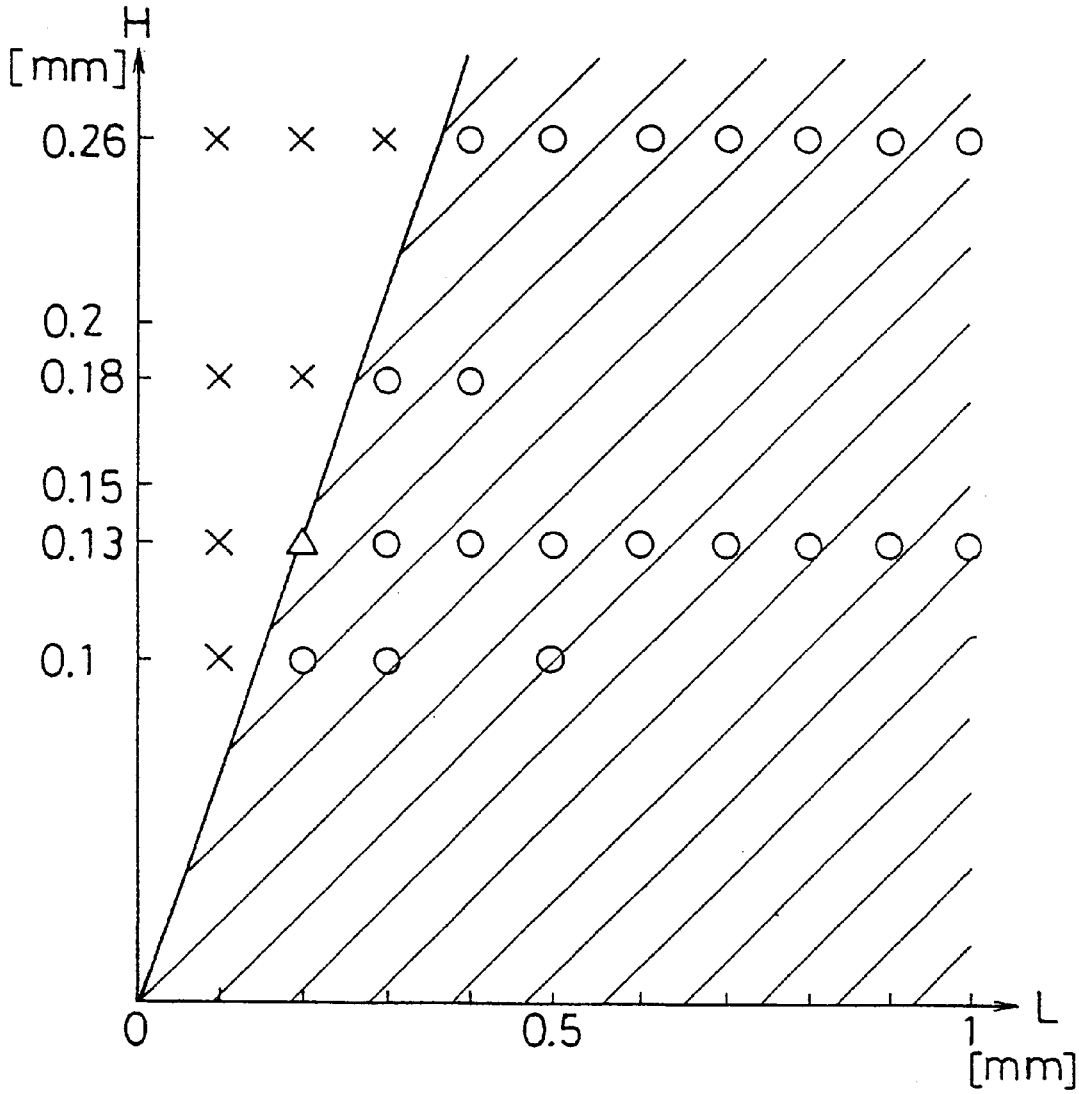
FIG. 4 is a graph showing a toner layer formation condition at a relationship between the step S and a protrusion amount L in the blade of the developing apparatus of the first embodiment of the present invention.

FIG. 4 is a graph showing the relationship among the height H of the step S, the protrusion amount L of the second blade plate 60B and the layer formation condition. In the graph of FIG. 4, the longitudinal axis represents the height H [mm] of the step S, and the lateral axis represents the protrusion amount L [mm] of the second blade plate 60B In the graph of FIG. 4, the mark ○ represents a position where the layer formation condition was excellent, and the mark Δ represents a position where nonuniformity was found although a certain degree of layer formation condition was obtained. The mark x represents a position where hardly any layer was formed.

From the results shown in FIG. 4, the height H of the step S and the protrusion amount L of the second blade plate 60B satisfy a relationship $H \leqq 0.7L$. As shown in the above-described FIG. 3, it is preferable that the height H of the step S be 2.0 mm or smaller. The results were particularly excellent when the height H was 0.5 mm or smaller.

In the first embodiment, It is necessary for the edge P of the first blade plate 60A only to have a curved surface with a radius of curvature of 0.5 mm or smaller; it is particularly preferable that the radius of curvature of the edge P be 0.1 mm or smaller. Thus, by decreasing the radius of curvature, the action of removing excessive one of the toner 1 conveyed by the rotation of the development roller 4 is enhanced. Consequently, in the developing apparatus of the first embodiment, a uniform toner thin layer was obtained with a lower pressure applied by the blade 60 to the development roller 4.

In the developing apparatus of the first embodiment, since the pressure applied by the blade 60 to the toner 1 when the toner layer was regulated was lower than that of the conventional developing apparatus, toner was prevented from cohering, so that the granularity improved.

Further, in the developing apparatus of the first embodiment, adhesion of the toner 1 to the edge P, etc. due to change over time did not easily occur, so that the life of the developing apparatus increased.

When the radius of curvature of the edge P is larger than 0.5 mm, to obtain a toner thin layer, a great force is necessary for pressing on the toner 1 when the layer is formed. Consequently, the toner 1 easily cohered and the granularity was deteriorated according to the toner 1, so that it sometimes occurred that toner adhered to the vicinity of the edge P due to change over time and streaks were generated in the image.

In the developing apparatus of the first embodiment, it is preferable that the surface roughness Ra (the average roughness at the center line) of the pressed surface q opposed to the first blade plate 60A in the pressed portion Q where the first blade plate 60A is pressed against the development roller 4 be 0.1 μm or more. The results were particularly excellent when the surface roughness Ra of the surface q was 0.3 to 1.0 μm. By increasing the surface roughness of the pressed surface q of the first blade plate 60A, the toner 1 is sufficiently stirred when it passes the portion where the first blade plate 60A is pressed against the development roller 4. Consequently, even when the toner 1 was deteriorated due to change over time, the toner 1 was charged with stability, so that sharp images without any background development were obtained with stability.

According to an experiment by the inventors, when the surface roughness Ra was less than 0.1 μm, the toner was hardly stirred when it passed the portion where the first blade plate 60A was pressed against the development roller 4, so that background development was generated according to the toner 1 as the toner 1 was deteriorated due to change over time.

To increase the surface roughness of the pressed surface q of the first blade plate 60A, a mechanical method such as sandblasting or a chemical method such as plating or etching can be used.

While the blade 60 is at the same potential as the development roller 4 in the developing apparatus of the first embodiment, application of a negative voltage to the blade 60 promoted the movement of charges from the blade 60 to the toner 1, so that the amount of charges of the toner 1 increased. As a result, sharper images without any background development were obtained. It is preferable that the DC voltage applied to the blade 60 be −500 V or higher. The obtained images were particularly excellent when the voltage was −50 to −150 V. When the DC voltage applied to the blade 60 was lower than −500 V, a leak was caused between the blade 60 and the development roller 4, which disturbed the layer formation. The above-mentioned values of the DC voltage applied to the blade 60 are relative values to the development roller 4.

In the developing apparatus of the first embodiment, by superposing an AC voltage between the blade 60 and the development roller 4, no toner cohesion occurred even when the toner 1 was deteriorated due to change over time, so that uniform images without any background development or density nonuniformity were obtained. In the developing apparatus thus structured, observing the vicinity of the pressed portion Q where the first blade plate 60A was pressed against the development roller 4 at the time of layer formation, it was observed that the toner 1 vibrated violently between the first blade plate 60A and the development roller 4. It is preferable that the amplitude of the AC bias superposed between the blade 60 and the development roller 4 be 100 to 500 V (from 0 to the peak). It is particularly preferable that the amplitude be 200 to 300 V (from 0 to the peak). It is preferable that the frequency of the AC bias be 200 Hz to 5 kHz. The results were particularly excellent when the frequency was 500 Hz to 1.5 kHz.

According to an experiment by the inventors, when the amplitude of the AC bias superposed between the blade 60 and the development roller 4 was higher than 500 V (from 0 to the peak), a leak was caused, so that layer formation was disturbed. When the frequency of the AC bias was lower than 200 Hz, the pitch of shades of layer formation due to the reciprocating motion of the toner 1 was conspicuous. When the frequency was higher than 5 kH, the toner 1 did not follow the frequency and the superposition of the AC bias produced hardly any effects.

While the first blade plate 60A is made of a stainless steel plate in the developing apparatus of the first embodiment, the present invention is not limited thereto; it may be made of a different material such as a different metal, a rubber or a synthetic resin. When the first blade plate 60A is made of urethane rubber, the width of the portion of the first blade plate 60A pressed against the development roller 4 is larger, so that the amount of charges of the toner 1 is larger. Consequently, according to a developing apparatus using the first blade plate 60A made of urethane rubber, sharp images without any background development were obtained with stability even when toner was deteriorated due to change over time.

While the second blade plate 60B is made of a stainless steel plate in the developing apparatus of the first embodiment, the present invention is not limited thereto; it may be made of a different material such as a different metal, a rubber or a synthetic resin. When the second blade plate 60B was made of an elastic material such as urethane rubber, variation in pressure in the toner reservoir in the opposed position R was reduced by the elasticity of the urethane rubber, so that an image hysteresis phenomenon such as sleeve memory was reduced.

While the thickness of the second blade plate 60B is 150 μm in the developing apparatus of the first embodiment, the thickness of the second blade plate 60B of the present invention is not limited to 150 μm. A uniform toner thin layer was obtained with stability as long as the second blade plate 60B had a certain degree of rigidity.

According to an experiment by the inventors, when the rigidity of the second blade plate 60B was low, the toner reservoir was not stably formed in the opposed portion R where the second blade plate 60B and the development roller 4 are opposed to each other in the upstream side (D up) of the step S in the rotation direction of the development roller 4, so that the toner thin layer on the development roller 4 was extremely thin and nonuniform.

Figure 5:
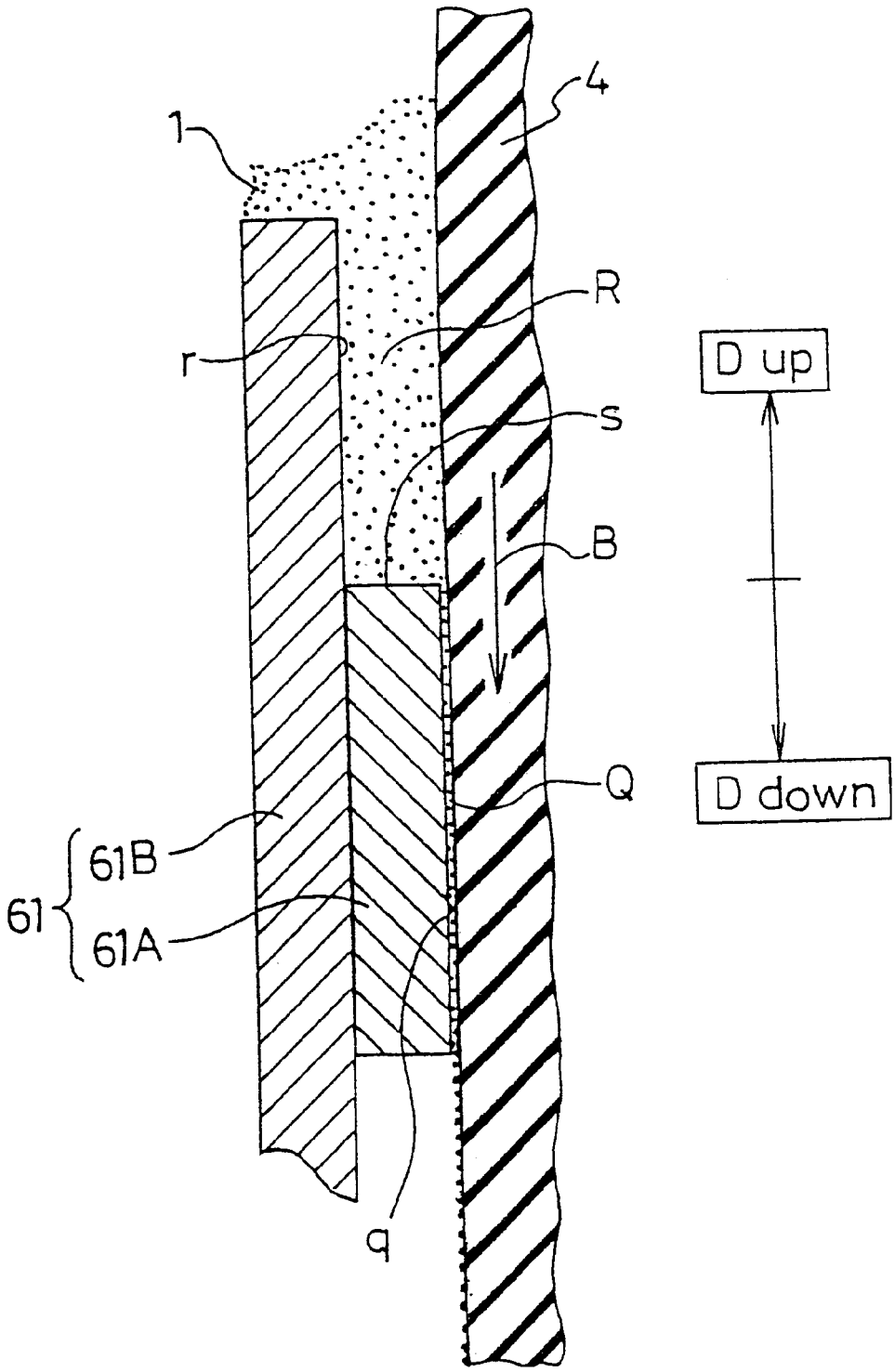
FIG. 5 is an enlarged cross-sectional view showing a portion where another blade is pressed against the development roller and a portion therearound in the developing apparatus of the first embodiment.

While in the first embodiment, the blade 60 comprises the first blade plate 60A and the second blade plate 60B bonded together so as to overlap each other and the first blade plate 60A is fixed to the development hopper 2 as shown in FIG. 2, the blade 60 may be fixed in a different manner. FIG. 5 is an enlarged cross-sectional view showing another example of the blade serving as the developer regulating member in the developing apparatus. As shown in FIG. 5, in a blade 61 of the developing apparatus of the present invention, the length of a second blade plate 61B in the rotation direction of the development roller 4 (the direction of the arrow B) is larger than the length of a first blade plate 61A, and the second blade plate 61B is fixed to the body of the developing apparatus. In this structure, the first blade plate 61A is pressed against the development roller 4 by the elasticity of the second blade plate 61B. Consequently, the first blade plate 61A and the second blade plate 61B do not easily come off.

Figure 6:
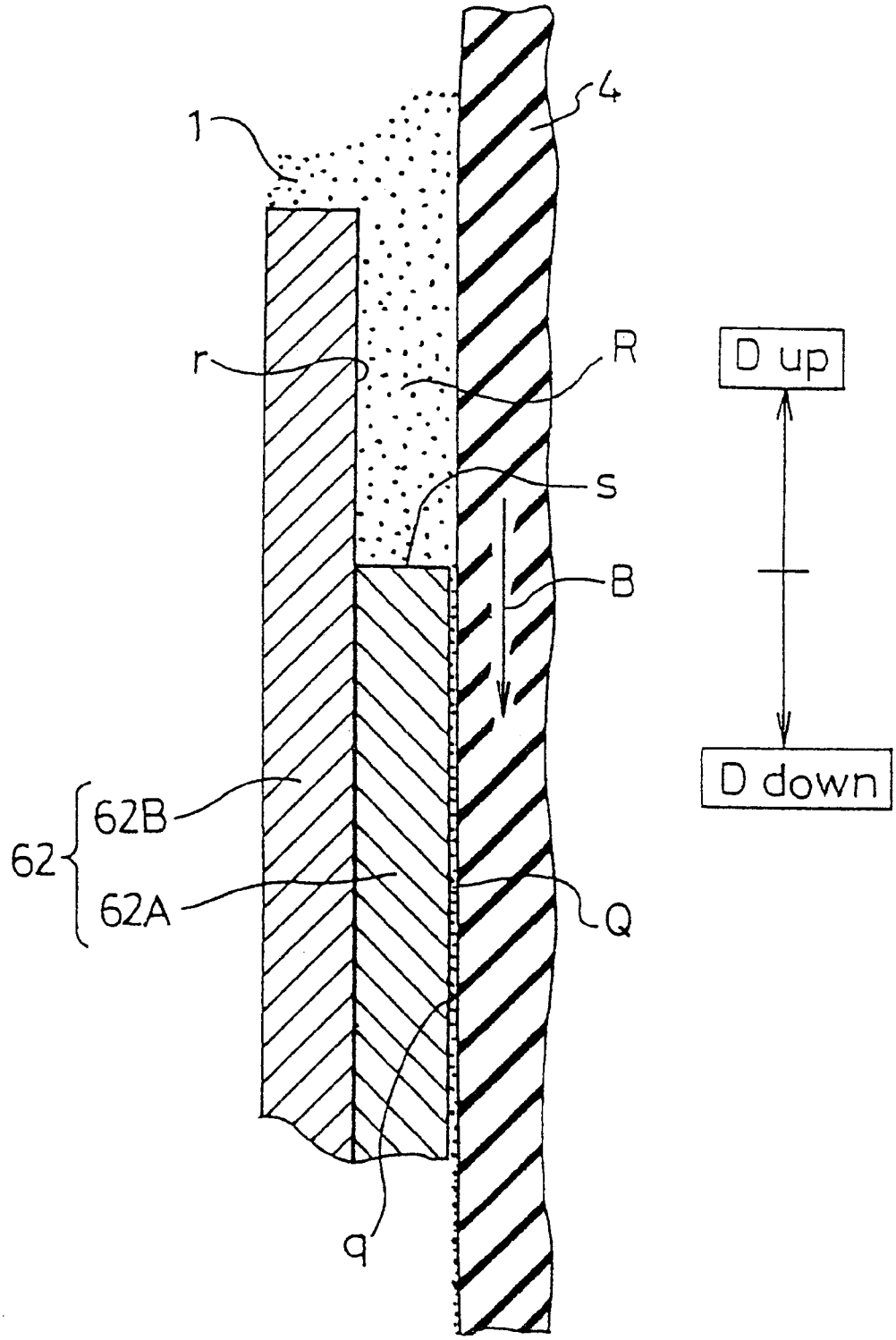
FIG. 6 is an enlarged cross-sectional view showing a portion where another blade is pressed against the development roller and a portion therearound in the developing apparatus of the first embodiment.

FIG. 6 is an enlarged cross-sectional view showing still another example of the blade serving as the developer regulating member in the developing apparatus. In a blade 62 of the developing apparatus shown in FIG. 6, the lengths of a first blade plate 62A and a second blade plate 62B in the rotation direction of the development roller 4 (the direction of the arrow B) are substantially the same. In this structure, both of the first blade plate 62A and the second blade plate 62B can be fixed to the development hopper 2, so that the first blade plate 62A and the second blade plate 62B are not necessarily bonded together. The developing apparatus shown in FIG. 6 can be manufactured by a simple process since it can be structured without the first blade plate 62A and the second blade plate 62B being bonded.

While a silicone rubber roller is used as the development roller 4 in the developing apparatus of the first embodiment, the present invention is not limited thereto; a roller made of a different elastic material may be used. When the development roller 4 was formed by use of urethane having high wear resistance, the development roller 4 was not worn and lasted long.

In the first embodiment, when the portion of the blade pressed against the development roller 4 is made of an elastic material such as urethane rubber, the development roller 4 may be made of a hard material such as a metal or a synthetic resin.

While non-magnetic toner is used in the developing apparatus of the first embodiment, magnetic toner may be used. However, in an experiment using magnetic toner, slight scraping was found at the edge P after continuous printing of 10,000 sheets, so that fine streaks appeared on halftone images.

While a contact phenomenon is used between the development roller 4 and the organic photoconductor 3 in the developing apparatus of the first embodiment, a non-contact phenomenon may be used. Moreover, the voltage applied to the development roller in the present invention is not limited to a DC voltage; an AC voltage may be superposed.

While in the developing apparatus of the first embodiment, the blade 60 disposed in a vertical direction to the outer surface of the development roller 4 is pressed against the development roller 4 as shown in FIG. 1, the present invention is not limited to this structure. Similar effects to those produced by the developing apparatus of the first embodiment are produced, for example, when the blade disposed in a horizontal direction (the side-to-side direction in FIG. 1) to the outer surface of the development roller 4 is pressed against the development roller 4.

Second Embodiment

Figure 7:
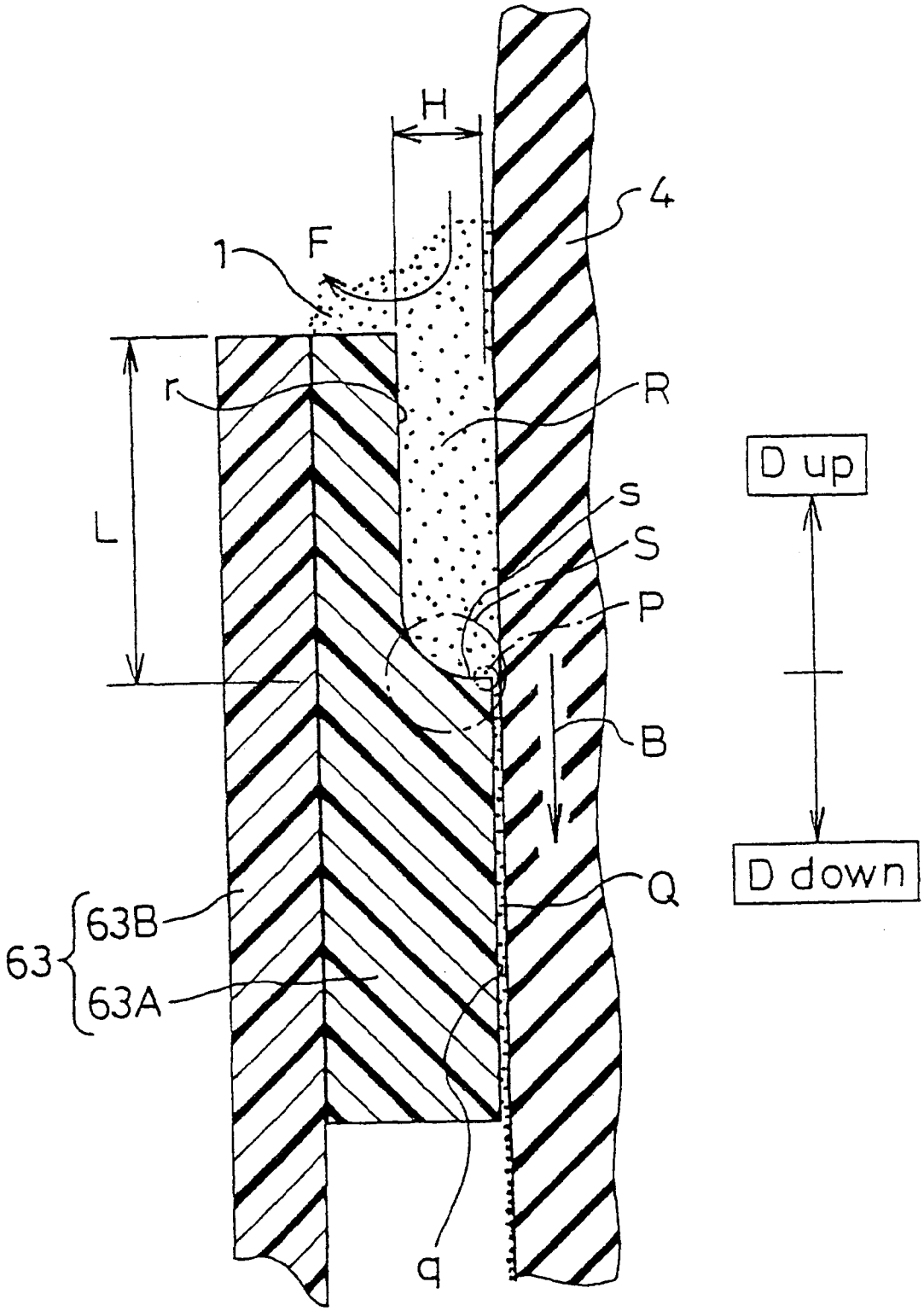
FIG. 7 is an enlarged cross-sectional view showing a portion where a blade is pressed against a development roller and a portion therearound in a developing apparatus according to a second embodiment of the present invention.

Hereinafter, a developing apparatus according to a second embodiment of the present invention will be described with reference to the accompanying drawings. FIG. 7 is a cross-sectional view showing a portion where a blade is pressed against a development roller and a portion therearound in the developing apparatus of the second embodiment. Since the structure of the developing apparatus of the second embodiment is the same as that of the developing apparatus of the above-described first embodiment except the blade, elements and portions having the same functions and structures are designated by the same reference numerals and the description thereof is omitted.

As shown In FIG. 7, a blade 63 comprises a first blade plate 63A and a second blade plate 63B bonded together. The first blade plate 63A has a step S and is made of conductive urethane resin containing carbon. The second blade plate 63B is made of conductive urethane resin with a thickness of 150 μm. The first blade plate 63A is pressed against the development roller 4 at the pressed portion Q including the edge P constituted by the step S. The height H of the step S of the first blade plate 63A is 150 μm. The height H is the distance between the pressed surface q and the opposed surface r of the first blade plate 63A. In the upstream side (D up) of the step S in the rotation direction of the development roller 4, the first blade plate 63A and the development roller 4 are opposed to each other with a predetermined space therebetween. The length of the opposed portion R is 1 mm. In the downstream side (D down) of the step S in the rotation direction of the development roller 4, the first blade plate 63A is pressed against the development roller 4.

The toner 1 used in the second embodiment and the operation of the developing apparatus are the same as those of the developing apparatus of the above-described first embodiment. Therefore, the description thereof is omitted.

The toner thin layer on the development roller 4 in the developing apparatus of the second embodiment is extremely uniform. No streaks due to toner adhesion are generated in the toner thin layer, and the developing apparatus of the second embodiment is capable of forming a uniform toner thin layer with stability.

The images obtained by the developing apparatus of the second embodiment were always stable in maximum image density. According to the developing apparatus of the second embodiment, high-quality images without any background development were obtained with stability even after continuous printing of 10,000 sheets.

Observing the blade 63 after continuous printing, there was not any scraping at the edge P of the first blade plate 63A or in the pressed portion Q where the plate 63A was pressed against the development roller 4.

While the height H of the step S of the first blade plate 63A is 150 $\mu$m in the second embodiment, it is preferable that the height H of the step S be 2.0 mm or smaller. The results were particularly excellent when the height H was 0.5 mm or smaller. Moreover, while the length L of the opposed portion R where the first blade plate 63A and the development roller 4 are opposed to each other is 1 mm in the second embodiment, according to an experiment, it is preferable that the length L of the opposed portion R be 0.2 mm or larger. The results were particularly excellent when the length L was 0.5 to 3 mm.

On the contrary, when the height H of the step S was larger than 2 mm and when the length L of the opposed portion R was smaller than 0.2 mm, the pressure applied to the toner 1 in the toner reservoir in the opposed portion R where the first blade plate 63A and the development roller 4 were opposed to each other was low Consequently, the toner thin layer was extremely thin and nonuniform.

However, even when the height H of the step S was within the above-mentioned appropriate range, when the height H of the step S was larger than the length L of the opposed portion R, the pressure applied to the toner 1 in the toner reservoir in the opposed portion R where the first blade plate 63A and the development roller 4 were opposed to each other was low according to the toner 1. Consequently, the toner thin layer was extremely thin and nonuniform.

In the developing apparatus of the second embodiment, the edge P constituted by the step S in the first blade plate 63A may have a curved surface having a certain degree of curvature. According to an experiment, it is preferable that the radius of curvature be 0.5 mm or smaller. The results were particularly excellent when the radius of curvature was 0.1 mm or smaller. By decreasing the radius of curvature, the action of removing excessive one of the toner 1 conveyed by the rotation of the development roller 4 is enhanced. Consequently, the blade 63 could form a uniform toner thin layer with a lower pressure. Since the blade 63 pressed on the toner 1 with a low pressure when the toner layer was regulated, toner cohesion did not easily occur, so that the granularity improved.

In the developing apparatus of the second embodiment, when the radius of curvature of the edge P was 0.5 mm or smaller, adhesion of the toner 1 to the edge P, etc. due to change over time did not easily occur, so that the life of the developing apparatus increased.

When the radius of curvature of the edge P is larger than 0.5 mm, to obtain a toner thin layer, it is necessary for the blade 63 to press on the toner 1 with a great force when the layer is formed, so that the toner 1 easily coheres and the granularity is deteriorated according to the material of the toner 1. Moreover, it sometimes occurred that the toner 1 adhered to the vicinity of the edge P due to change over time and streaks were generated on images.

In the developing apparatus of the second embodiment, it is preferable that the surface roughness Ra of the pressed surface q of the first blade plate 63A pressed against the development roller 4 be 0.1 $\mu$m or more. The results were particularly excellent when the surface roughness Ra was 0.3 to 1.0 $\mu$m. By increasing the surface roughness of the pressed surface q of the first blade plate 63A, the toner 1 is sufficiently stirred when it passes the portion where the first blade plate 63A is pressed against the development roller 4. Consequently, even when the toner 1 is deteriorated due to change over time, the toner 1 can be charged with stability. According to the developing apparatus of the second embodiment, sharp images without any background development were obtained with stability. When the surface roughness Ra was less than 0.1, the toner was hardly stirred when it passed the portion where the first blade plate 63A was pressed against the development roller 4, so that background developer was generated according to the kind of the toner 1 as the toner 1 was deteriorated due to change over time.

While the blade 63 is at the same potential as the development roller 4 in the developing apparatus of the second embodiment, application of a negative voltage to the blade 63 promoted the movement of charges from the blade 63 to the toner 1, so that the amount of charges of the toner 1 increased. Consequently, according to the developing apparatus of the above-described structure, shaper images without any background development were obtained It is preferable that the DC voltage applied to the blade 63 be −500 V or higher. The obtained images were particularly excellent when the voltage was −50 to −150 V. When the DC voltage applied to the blade 63 was lower than −500 V, a leak was caused between the blade 63 and the development roller 4, which disturbed the layer formation. The above-mentioned values of the DC voltage applied to the blade 63 are relative values to the development roller 4.

In the developing apparatus of the second embodiment, by superposing an AC voltage between the blade 63 and the development roller 4, no toner cohesion occurred even when the toner 1 was deteriorated due to change over time, so that uniform images without any background development or density nonuniformity were obtained. In the developing apparatus thus structured, observing the vicinity of the pressed portion Q where the first blade plate 63A was pressed against the development roller 4 at the time of layer formation, it was observed that the toner 1 vibrated violently between the first blade plate 63A and the development roller 4. It is preferable that the amplitude of the AC bias superposed between the blade 63 and the development roller 4 be 100 to 500 V (from 0 to the peak). The results were particularly excellent when the amplitude was 200 to 300 V (from 0 to the peak). It is preferable that the frequency of the AC bias be 200 Hz to 5 kHz. The results were particularly excellent when the frequency was 500 Hz to 1.5 kHz.

According to an experiment by the inventors, when the amplitude of the AC bias superposed between the blade 63 and the development roller 4 was higher than 500 V (from 0 to the peak), a leak was caused, so that layer formation was disturbed. When the frequency of the AC bias was lower than 200 Hz, the pitch of shades of layer formation due to the reciprocating motion of the toner 1 was conspicuous.

When the frequency was higher than 5 kH, the toner 1 did not follow the frequency and the superposition of the AC bias produced hardly any effects.

While the first blade plate 63A is made of conductive urethane resin containing carbon in the developing apparatus of the second embodiment, the present invention is not limited thereto; the first blade plate 63A may be made of a different conductive material such as a metal, a conductive rubber or a conductive synthetic resin. When the first blade plate 63A is made of conductive urethane rubber, the width of the portion of the first blade plate 63A pressed against the development roller 4 is larger, so that the amount of charges of the toner 1 is larger. Consequently, sharp images without any background development were obtained with stability even when toner was deteriorated due to change over time.

While a silicone rubber roller is used as the development roller 4 in the developing apparatus of the second embodiment, the present invention is not limited thereto; a roller made of a different elastic material may be used. For example, when the development roller 4 was made of urethane rubber having high wear resistance, the development roller 4 was not worn and lasted long. In the second embodiment, when the portion of the blade 63 pressed against the development roller 4 is made of an elastic material such as urethane rubber, the development roller 4 may be a roller made of a hard material such as a metal or a resin.

While non-magnetic toner is used in the developing apparatus of the second embodiment, magnetic toner may be used. However, when magnetic toner is used, slight scraping was found at the edge P of the first blade plate 63A after continuous printing of 10,000 sheets, so that fine streaks appeared on halftone images.

While a contact phenomenon is used between the development roller 4 and the organic photoconductor 3 in the developing apparatus of the second embodiment, a non-contact phenomenon may be used. Moreover, the voltage applied to the development roller in the present invention is not limited to a DC voltage; an AC voltage may be superposed.

While in the developing apparatus of the second embodiment, the blade 63 disposed vertically to the development roller 4 is pressed against the development roller 4, the present invention is not limited to this structure. Similar effects to those produced by the developing apparatus of the second embodiment are produced, for example, when the blade disposed horizontally to the development roller 4 is pressed against the development roller 4.

While in the developing apparatus of the second embodiment, the blade 63 comprises the first blade plate 63A and the second blade plate 63B bonded together, it may be integrally formed of synthetic resin, rubber or a metal into the configuration shown in FIG. 7. Moreover, similar effects to those produced by the blade 63 of the second embodiment were obtained when the blade 63 was made of an integral member of a synthetic resin, a rubber or a metal processed into the configuration shown in FIG. 7.

Third Embodiment

Figure 8:
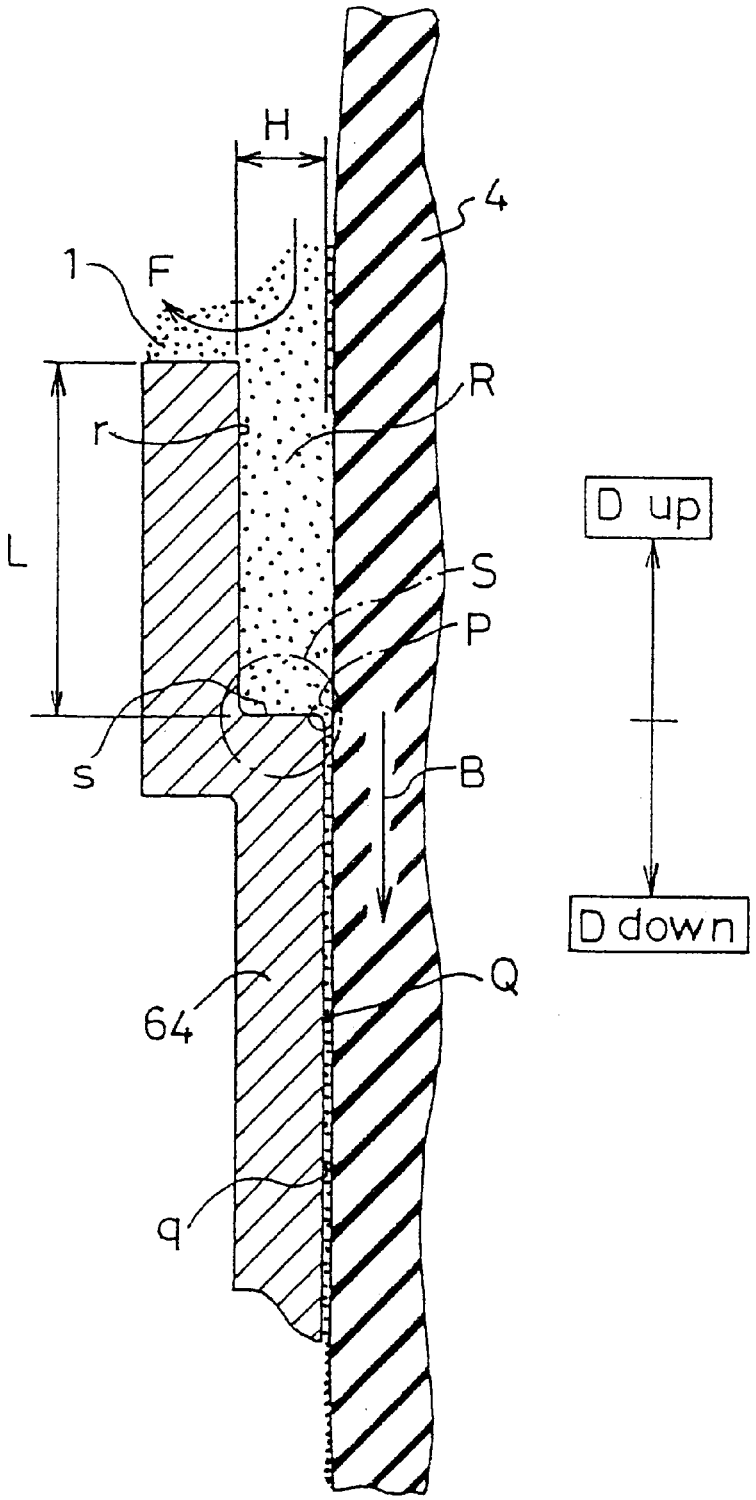
FIG. 8 is an enlarged cross-sectional view showing a portion where a blade is pressed against a development-roller and a portion therearound in a third embodiment of the present invention.

Hereinafter, a developing apparatus according to a third embodiment of the present invention will be described with reference to the accompanying drawings. FIG. 8 is a cross-sectional view showing a portion where a blade is pressed against a development roller and a portion therearound in the developing apparatus of the third embodiment of the present invention. Since the structure of the developing apparatus of the third embodiment is the same as that of the developing apparatus of the above-described first embodiment except the blade, elements and portions having the same functions and structures are designated by the same reference numerals and the description thereof is omitted.

As shown in FIG. 8, a blade 64 has a step S formed by bending a plate of stainless steel (SUS304). The blade 64 is pressed against the development roller 4 at the pressed surface q including the edge P constituted by the step S. The height H of the step S of the blade 64 is 150 $\mu$m. In the upstream side (D up) of the step S in the rotation direction of the development roller 4, the blade 64 and the development roller 4 are opposed to each other with the opposed portion R serving as the toner reservoir therebetween The length L of the opposed portion is 1 mm. In the downstream side (D down) of the step S in the rotation direction of the development roller 4, the blade 64 is pressed against the development roller 4.

The toner 1 used in the third embodiment is the same as the toner 1 used in the above-described first embodiment and the operation of the developing apparatus of the third embodiment is the same as the operation of the developing apparatus of the first embodiment. Therefore, the description thereof is omitted.

The toner thin layer on the development roller 4 in the developing apparatus of the third embodiment is extremely uniform. No streaks due to toner adhesion are generated in the toner thin layer, and the developing apparatus of the third embodiment is capable of forming a uniform toner thin layer with stability.

The images obtained by the developing apparatus of the third embodiment were always stable in maximum image density. According to the developing apparatus of the third embodiment, high-quality images without any background development were obtained with stability even after continuous printing of 10,000 sheets.

Observing the blade 64 after continuous printing, there was not any scraping at the edge P of the blade 64 or on the surface q pressed against the development roller 4.

While the height H of the step S of the blade 64 is 150 $\mu$m in the third embodiment, according to an experiment, it is preferable that the height H of the step S be 2.0 mm or smaller. The results were particularly excellent when the height H was 0.5 mm or smaller. Moreover, while the length L of the opposed portion R where the blade 64 and the development roller 4 are opposed to each other is 1 mm, it is preferable that the length L of the opposed portion R be 0.2 mm or larger. The results were particularly excellent when the length L was 0.5 to 3 mm.

On the contrary, when the height H of the step S was larger than 2 mm and when the length L of the opposed portion R was smaller than 0.2 mm, the pressure applied to the toner 1 in the toner reservoir in the opposed portion R where the blade 64 and the development roller 4 were opposed to each other was low. Consequently, the toner thin layer was extremely thin and nonuniform.

However, even when the height H of the step S was within the above-mentioned appropriate range, when the height H of the step S was larger than the length L of the opposed portion R, the pressure applied to the toner 1 in the toner reservoir in the opposed portion R where the blade 64 and the development roller 4 were opposed to each other was low according to the toner 1. Consequently, the toner thin layer was extremely thin and nonuniform.

In the developing apparatus of the third embodiment, the edge P constituted by the step S in the blade 64 may have a curved surface having a certain degree of curvature. In that case, it is preferable that the radius of curvature be 0.5 mm or smaller. The results were particularly excellent when the radius of curvature was 0.1 mm or smaller. By decreasing the radius of curvature, the action of removing excessive one of the toner 1 conveyed by the rotation of the development roller 4 is enhanced. Consequently, the blade 64 could form a uniform toner thin layer with a force of a lower torque. Since the blade 64 pressed on the toner 1 with a small force when the toner layer was regulated, toner cohesion did not easily occur, so that the granularity improved.

In the developing apparatus of the third embodiment, when the radius of curvature of the edge P was 0.5 mm or smaller, adhesion of the toner 1 to the edge P, etc. due to change over time did not easily occur, so that the life of the developing apparatus increased.

On the contrary, when the radius of curvature of the edge P is larger than 0.5 mm, to obtain a toner thin layer, it is necessary for the blade 64 to press on the toner 1 with a great force when the layer is formed, so that the toner 1 easily coheres and the granularity is deteriorated according to the toner 1. Moreover, it sometimes occurred that the toner 1 adhered to the vicinity of the edge P due to change over time and streaks were generated on images.

In the developing apparatus of the third embodiment, it is preferable that the surface roughness Ra of the pressed surface q of the blade 64 pressed against the development roller 4 be 0.1 $\mu$m or more. The results were particularly excellent when the surface roughness Ra was 0.3 to 1.0 $\mu$m. By increasing the surface roughness of the pressed surface q of the blade 64, the toner 1 is sufficiently stirred when it passes the portion where the blade 64 is pressed against the development roller 4. Consequently, even when the toner 1 is deteriorated due to change over time, the toner 1 can be charged with stability. According to the developing apparatus of the third embodiment, sharp images without any background development were obtained with stability. When the surface roughness Ra was less than 0.1, the toner 1 was hardly stirred when it passed the portion where the blade 64 was pressed against the development roller 4, so that background development was generated according to the toner 1 as the toner 1 was deteriorated due to change over time. Methods of increasing the surface roughness of the pressed surface q of the blade 64 include a mechanical method such as sandblasting and chemical methods such as etching and plating.

While the blade 64 is at the same potential as the development roller 4 in the developing apparatus of the third embodiment, application of a negative voltage to the blade 64 promoted the movement of charges from the blade 64 to the toner 1, so that the amount of charges of the toner 1 increased. Consequently, according to the developing apparatus of the above-described structure, shaper images without any background development were obtained. It is preferable that the DC voltage applied to the blade 64 be −500 V or higher. The obtained images were particularly excellent when the voltage was −50 to −150 V. When the DC voltage applied to the blade 64 was lower than −500 V, a leak was caused between the blade 64 and the development roller 4, which disturbed the layer formation. The above-mentioned values of the DC voltage applied to the blade 64 are relative values to the development roller 4.

In the developing apparatus of the third embodiment, by superposing an AC voltage between the blade 64 and the development roller 4, no toner cohesion occurred even when the toner 1 was deteriorated due to change over time, so that uniform images without any background development or density nonuniformity were obtained. In the developing apparatus thus structured, observing the vicinity of the pressed portion Q where the blade 64 was pressed against the development roller 4 at the time of layer formation, it was observed that the toner 1 vibrated violently between the blade 64 and the development roller 4. It is preferable that the amplitude of the AC bias superposed between the blade 64 and the development roller 4 be 100 to 500 V (from 0 to the peak). The results were particularly excellent when the amplitude was 200 to 300 V (from 0 to the peak). It is preferable that the frequency of the AC bias be 200 Hz to 5 kHz. The results were particularly excellent when the frequency was 500 Hz to 1.5 kHz.

According to an experiment by the inventors, when the amplitude of the AC bias superposed between the blade 64 and the development roller 4 was higher than 500 V (from 0 to the peak), a leak was caused, so that layer formation was disturbed. When the frequency of the AC bias was lower than 200 Hz, the pitch of shades of layer formation due to the reciprocating motion of the toner 1 was conspicuous. When the frequency was higher than 5 kH, the toner 1 did not follow the frequency and the superposition of the AC bias produced hardly any effects.

While the blade 64 is made of a stainless steel plate in the developing apparatus of the third embodiment, the present invention is not limited thereto; the blade 64 may be made of a different material such as a different metal, a rubber or a synthetic resin.

While a silicone rubber roller is used as the development roller 4 in the developing apparatus of the third embodiment, the present invention is not limited thereto; a roller made of a different elastic material may be used. When the development roller 4 was made of urethane rubber having high wear resistance, the development roller 4 was not worn and lasted long.

While non-magnetic toner is used in the developing apparatus of the third embodiment, magnetic toner may be used. However, when magnetic toner was used, slight scraping was found at the edge P of the blade 64 after continuous printing of 10,000 sheets, so that fine streaks appeared on halftone images.

While a contact phenomenon is used between the development roller 4 and the organic photoconductor in the developing apparatus of the third embodiment, a non-contact phenomenon may be used. Moreover, the voltage applied to the development roller 4 in the present invention is not limited to a DC voltage; an AC voltage may be superposed.

While in the developing apparatus of the third embodiment, the blade 64 disposed vertically to the development roller 4 is pressed to the development roller 4, the present invention is not limited to this structure. Similar effects to those produced by the developing apparatus of the third embodiment are produced, for example, when the blade disposed horizontally to the development roller is pressed against the development roller 4.

Fourth Embodiment

Figure 9:
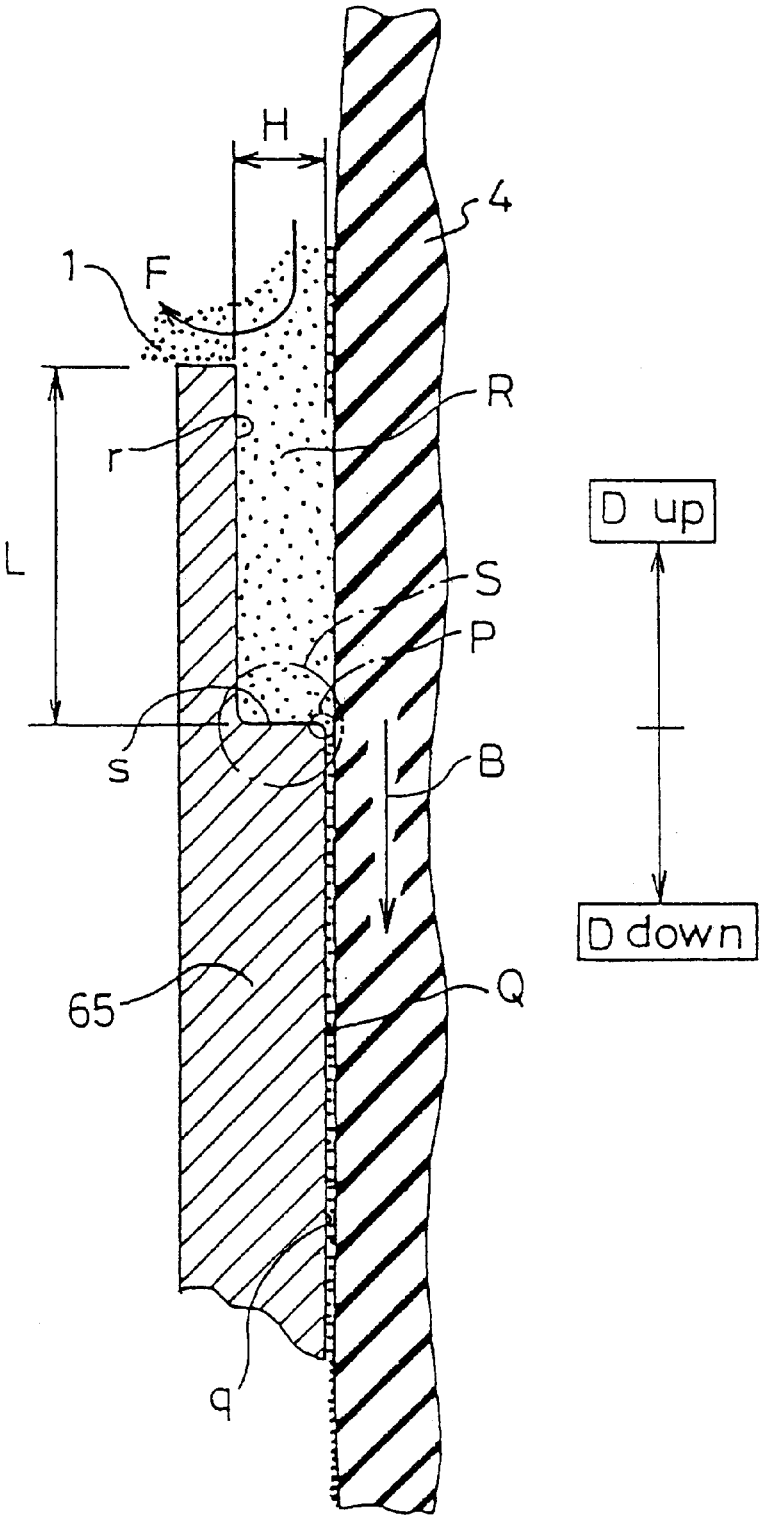
FIG. 9 is an enlarged cross-sectional view showing a portion where a blade is pressed against a development roller and a portion therearound in a fourth embodiment of the present invention.

Hereinafter, a developing apparatus according to a fourth embodiment of the present invention will be described with reference to the accompanying drawings. FIG. 9 is a cross-sectional view showing a portion where a blade is pressed against a development roller and a portion therearound in the developing apparatus of the fourth embodiment of the present invention. Since the structure of the developing apparatus of the fourth embodiment is the same as that of the developing apparatus of the above-described first embodiment except the blade, elements and portions having the same functions and structures are designated by the same reference numerals and the description thereof is omitted.

As shown in FIG. 9, the blade 65 has a step S formed by cutting away a part of a stainless steel plate with a thickness of 150 μm by etching. The blade 65 is pressed against the development roller 4 at the pressed surface q including the edge P constituted by the step S. The height H of the step S of the blade 65 is 100 μm. In the upstream side (D up) of the step S in the rotation direction of the development roller 4, the blade 65 and the development roller 4 are opposed to each other with the opposed portion R therebetween. The length of the opposed portion is 1 mm. In the downstream side (D down) of the step S in the rotation direction of the development roller 4, the blade 65 is pressed against the development roller 4. The surface s constituting the step S is substantially vertical to the pressed surface of the development roller 4. The opposed surface r of the blade 65 opposed to the development roller 4 is substantially parallel to the pressed surface of the development roller 4.

The toner 1 used in the fourth embodiment is the same as the toner 1 used in the above-described first embodiment and the operation of the developing apparatus of the fourth embodiment is the same as the operation of the developing apparatus of the first embodiment. Therefore, the description thereof is omitted.

In the developing apparatus of the fourth embodiment, since the blade 65 is formed as shown in FIG. 9, the toner thin layer on the development roller 4 is not extremely uniformly formed, so that streaks are prevented from being generated on the toner thin layer due to toner adhesion. Consequently, the developing apparatus of the fourth embodiment is capable of forming a uniform toner thin layer with stability.

The images obtained by the developing apparatus of the fourth embodiment are always stable in maximum image density. According to the developing apparatus of the third embodiment, high-quality images without any background development were obtained with stability even after continuous printing of 10,000 sheets.

Observing the blade 65 after continuous printing, there was not any scraping at the edge P of the blade 65 or in the portion Q where the blade 65 was pressed against the development roller 4.

While the height H of the step S of the blade 65 is 100 μm in the fourth embodiment, it is preferable that the height H of the step S be 2.0 mm or smaller when the thickness of the stainless steel plate is larger. The results were particularly excellent when the height H was 0.5 mm or smaller. Moreover, while the length L of the opposed portion R where the blade 65 and the development roller 4 are opposed to each other is 1 mm, it is preferable that the length L of the opposed portion R be 0.2 mm or larger. The results were particularly excellent when the length L was 0.5 to 3 mm.

On the contrary, when the height H of the step S was larger than 0.2 mm and when the length L of the opposed portion R was smaller than 0.2 mm, the pressure applied to the toner 1 in the toner reservoir in the opposed portion R where the blade 65 and the development roller 4 were opposed to each other was low. Consequently, the toner thin layer was extremely thin and nonuniform.

However, even when the height H of the step S was within the above-mentioned appropriate range, when the height H of the step S was larger than the length L of the opposed portion R, the pressure applied to the toner 1 in the toner reservoir in the opposed-portion R where the blade 65 and the development roller 4 were opposed to each other was low according to the toner 1. Consequently, the toner thin layer was extremely thin and nonuniform.

In the developing apparatus of the fourth embodiment, the edge P constituted by the step S in the blade 65 may have a curved surface having a certain degree of curvature. In that case, it is preferable that the radius of curvature be 0.5 mm or smaller. The results were particularly excellent when the radius of curvature was 0.1 mm or smaller. By decreasing the radius of curvature, the action of removing excessive one of the toner 1 conveyed by the rotation of the development roller 4 is enhanced. Consequently, the blade 65 having a small radius of curvature could form a uniform toner thin layer with a lower torque than a blade having a large radius of curvature. Since the blade 65 pressed on the toner 1 with a small force when the toner layer was regulated, toner cohesion did not easily occur, so that the granularity improved.

In the developing apparatus of the fourth embodiment, when the radius of curvature of the edge P was 0.5 mm or smaller, adhesion of the toner 1 to the edge P, etc. due to change over time did not easily occur, so that the life of the developing apparatus increased.

When the radius of curvature of the edge P is larger than 0.5 mm, to obtain a toner thin layer, it is necessary for the blade 65 to press on the toner 1 with a great force when the layer is formed, so that the toner 1 easily coheres and the graininess is deteriorated according to the toner 1. Moreover, it sometimes occurred that the toner 1 adhered to the vicinity of the edge P due to change over time and streaks were generated on images.

In the developing apparatus of the fourth embodiment, it is preferable that the surface roughness Ra of the pressed surface q of the blade 65 pressed against the development roller 4 be 0.1 μm or more. The results were particularly excellent when the surface roughness Ra was 0.3 to 1.0 μm. By increasing the surface roughness of the pressed surface q of the blade 65, the toner 1 is sufficiently stirred when it passes the portion where the blade 65 is pressed against the development roller 4. Consequently, even when the toner 1 is deteriorated due to change over time, the toner 1 can be charged with stability. According to the developing apparatus of the fourth embodiment, sharp images without any background development were obtained with stability. When the surface roughness Ra was less than 0.1 μm, the toner 1 was hardly stirred when it passed the portion where the blade 65 was pressed against the development roller 4, so that background development was generated according to the toner 1 as the toner 1 was deteriorated due to change over time. Methods of increasing the surface roughness of the pressed surface q of the blade 65 include a mechanical method such as sandblasting and chemical methods such as etching and plating.

While the blade 65 is at the same potential as the development roller 4 in the developing apparatus of the fourth embodiment, application of a negative voltage to the blade 65 promoted the movement of charges from the blade 65 to the toner 1, so that the amount of charges of the toner 1 increased. Consequently, according to the developing apparatus of the above-described structure, shaper images without any background development were obtained. It is preferable that the DC voltage applied to the blade 65 be −350 V or higher. The obtained images were particularly excellent when the voltage was −30 to −100 V. When the DC voltage applied to the blade 65 was lower than −350 V, a leak was caused between the blade 65 and the development roller 4, which disturbed the layer formation. The above-mentioned values of the DC voltage applied to the blade 65 are relative values to the development roller 4.

In the developing apparatus of the fourth embodiment, by superposing an AC voltage between the blade 65 and the development roller 4, no toner cohesion occurred even when the toner 1 was deteriorated due to change over time, so that uniform images without any background development or density nonuniformity were obtained. In the developing apparatus thus structured, observing the vicinity of the pressed portion Q where the blade 65 was pressed against the development roller 4 at the time of layer formation, it was observed that the toner 1 vibrated violently between the blade 65 and the development roller 4. It is preferable that the amplitude of the AC bias superposed between the blade 65 and the development roller 4 be 60 to 350 V (from 0 to the peak). The results were particularly excellent when the amplitude was 130 to 200 V (from 0 to the peak). It is preferable that the frequency of the AC bias be 200 Hz to 5 kHz. The results were particularly excellent when the frequency was 500 Hz to 1.5 kHz.

According to an experiment by the inventors, when the amplitude of the AC bias superposed between the blade 65 and the development roller 4 was higher than 350 V (from 0 to the peak), a leak was caused, so that layer formation was disturbed. When the frequency of the AC bias was lower than 200 Hz, the pitch of shades of layer formation due to the reciprocating motion of the toner 1 was conspicuous. When the frequency was higher than 5 kH, the toner 1 did not follow the frequency and the superposition of the AC bias produced hardly any effects.

While the blade 65 is made of a stainless steel plate in the developing apparatus of the fourth embodiment, the present invention is not limited thereto; the blade 65 may be made of a different material such as a different metal, a rubber or a synthetic resin.

While the step S is formed by etching in the developing apparatus of the fourth embodiment, the step may be formed by machining.

While a silicone rubber roller is used as the development roller 4 in the developing apparatus of the fourth embodiment, the present invention is not limited thereto; a roller made of a different elastic material may be used. When the development roller 4 was made of urethane having high wear resistance, the development roller 4 was not worn and lasted long.

While non-magnetic toner is used in the developing apparatus of the fourth embodiment, magnetic toner may be used. However, when magnetic toner was used, slight scraping was found at the edge P of the blade 65 after continuous printing of 10,000 sheets, so that fine streaks appeared on halftone images.

While a contact phenomenon is used between the development roller 4 and the organic photoconductor in the developing apparatus of the fourth embodiment, a non-contact phenomenon may be used. Moreover, the voltage applied to the development roller 4 in the present invention is not limited to a DC voltage; an AC voltage may be superposed.

While in the developing apparatus of the fourth embodiment, the blade 65 disposed vertically to the development roller 4 is pressed against the development roller 4, the present invention is not limited to this structure. Similar effects to those produced by the developing apparatus of the fourth embodiment are produced, for example, when the blade disposed horizontally to the development roller is pressed against the development roller 4.

Fifth Embodiment

Figure 10:
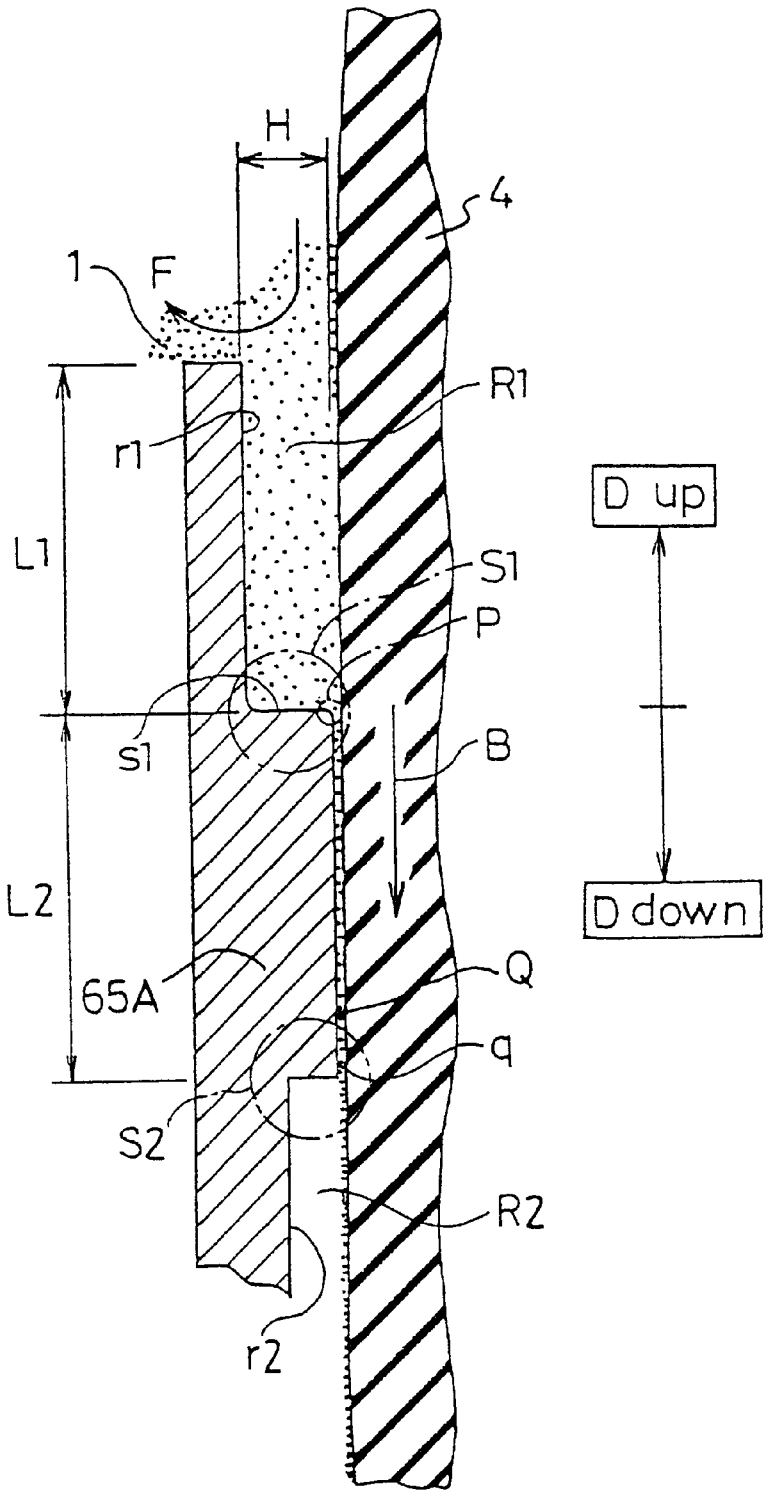
FIG. 10 is an enlarged cross-sectional view showing a portion where a blade is pressed against a development roller and a portion therearound in a fifth embodiment of the present invention.

Hereinafter, a developing apparatus according to a fifth embodiment of the present invention will be described with reference to the accompanying drawings. FIG. 10 is a cross-sectional view showing a portion where a blade is pressed against a development roller and a portion therearound in the developing apparatus of the fifth embodiment of the present invention. Since the structure of the developing apparatus of the fifth embodiment is the same as that of the developing apparatus of the above-described fourth embodiment except a blade 65A, elements and portions having the same functions and structures are designated by the same reference numerals and the description thereof is omitted.

As shown in FIG. 10, the blade 65A of the fifth embodiment has two steps S1 and S2 formed by cutting away two parts of a stainless steel plate with a thickness of 150 $\mu$m by etching. The blade 65A is pressed against the development roller 4 at the pressed surface q including the edge P constituted by the step S1. The height H of the step S1 of the blade 65A is 100 $\mu$m. In the upstream side (D up) of the step S1 in the rotation direction of the development roller 4, the blade 65A and the development roller 4 are opposed to each other with a first opposed portion R1 therebetween. The length of the opposed portion R1 is 1 mm. In the downstream side (D down) of the step S1 in the rotation direction of the development roller 4, the blade 65A is surely pressed against the development roller 4 at a predetermined distance (L2). A surface s1 constituting the step S1 is substantially vertical to the pressed surface of the development roller 4. An opposed surface r1 of the blade 65A opposed to the development roller 4 is substantially parallel to the pressed surface of the development roller 4.

The structure of the fifth embodiment is substantially the same as that of the above-described fourth embodiment except that the two steps S1 and S2 are provided.

Generally, when toner containing a large quantity of externally added agent such as silica is used, it sometimes occurs that silica, etc. adheres to the blade at the portion where the development roller 4 and the blade serving as the layer forming member are gradually separated from each other by the rotation of the development roller 4 and the adhesion causes nonuniformity in layer formation.

In the developing apparatus of the fifth embodiment, the development roller 4 and the blade 65A are separated not gradually but instantaneously while a distance sufficient for charging the toner 1 is secured as the distance (L2) where the blade 65A is pressed against the development roller 4. Consequently, there is no portion where the pressure applied to the toner 1 gradually decreases, so that silica, etc. is prevented from adhering to the blade 65A. As a result, according to the developing apparatus of the fifth embodiment, uniform images can be obtained with stability over time.

According to an experiment by the inventors, preferable results were obtained when the distance L2 where the blade 65A was pressed against the development roller 4 was not less than 0.3 mm and not more than 1.0 mm. The development roller 4 used in this experiment was the same as the development roller 4 of the above-described first embodiment, and as the blade 65A, one was used that was made by forming the second step S2 in the blade 65 used in the fourth embodiment.

Sixth Embodiment

Figure 11:
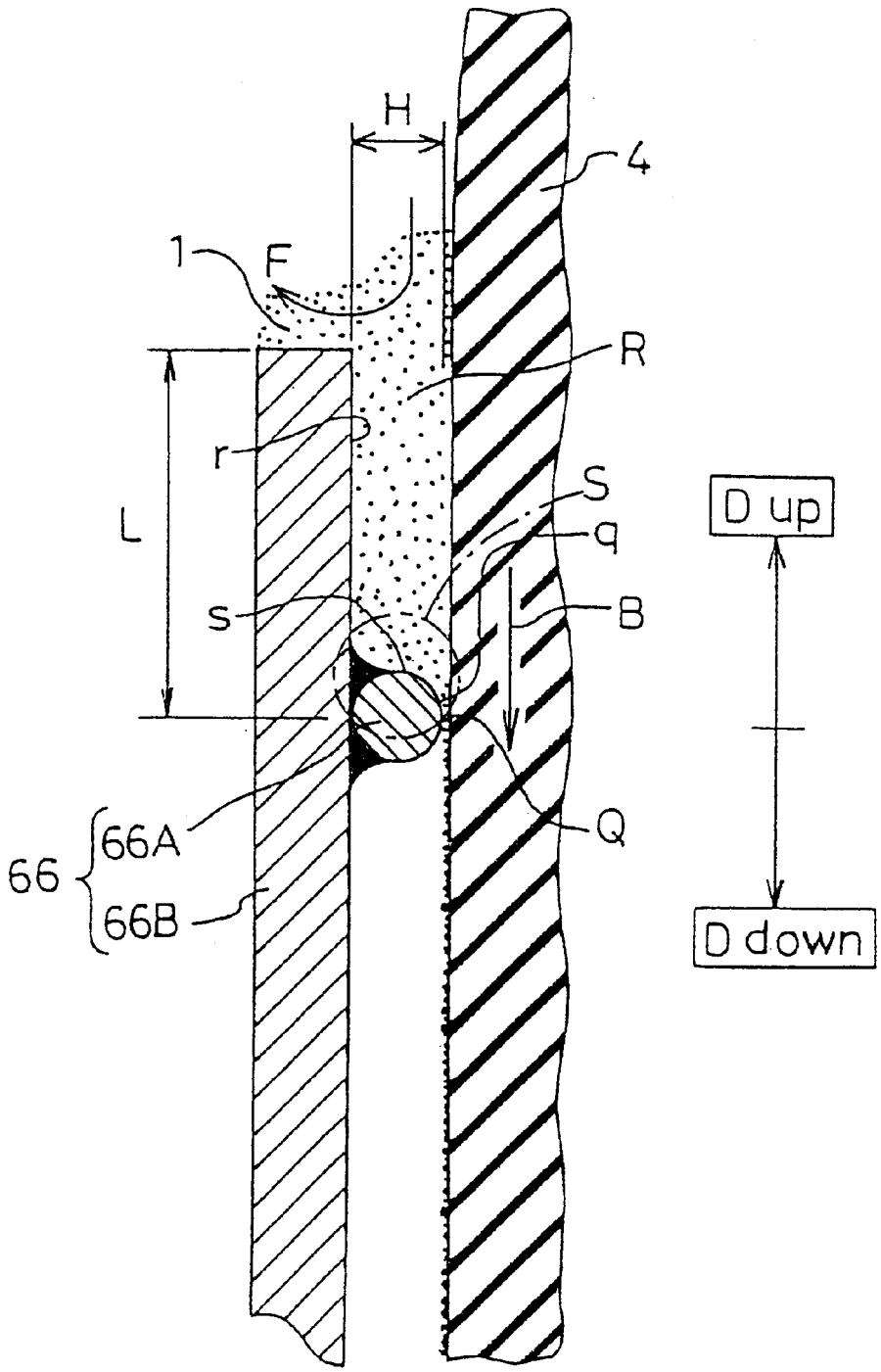
FIG. 11 is an enlarged cross-sectional view showing a portion where a blade is pressed against a development roller and a portion therearound in a sixth embodiment of the present invention.

Hereinafter, a developing apparatus according to a sixth embodiment of the present invention will be described with reference to the accompanying drawings. FIG. 11 is a cross-sectional view showing a portion where a blade is pressed against a development roller and a portion therearound in the developing apparatus of the sixth embodiment of the present invention. Since the structure of the developing apparatus of the sixth embodiment is the same as that of the developing apparatus of the above-described first embodiment except the blade, elements and portions having the same functions and structures are designated by the same reference numerals and the description thereof is omitted.

In FIG. 11, a blade 66 of the developing apparatus of the sixth embodiment is formed by welding a stainless-steel-made wire 66A with a radius of 0.2 mm to a second blade plate 66B with a thickness of 150 μm.

In the developing apparatus of the sixth embodiment, the wire 66A and the development roller 4 press on toner 1. The height H of the step S shown in FIG. 11 is 0.4 mm. In the upstream side (D up) of the step S in the rotation direction of the development roller 4, the second blade plate 66B and the development roller 4 are opposed to each other with the opposed portion R therebetween. The length L of the opposed portion is 1 mm.

The toner 1 used in the sixth embodiment is the same as the toner 1 used in the above-described first embodiment and the operation of the developing apparatus of the sixth embodiment is the same as the operation of the developing apparatus of the first embodiment. Therefore, the description thereof is omitted.

The toner thin layer on the development roller 4 in the developing apparatus of the sixth embodiment is extremely uniform. No streaks due to toner adhesion are generated in the toner thin layer, and the developing apparatus of the sixth embodiment is capable of forming a uniform toner thin layer with stability.

The images obtained by the developing apparatus of the sixth embodiment are always stable in maximum image density. According to the developing apparatus of the sixth embodiment, high-quality images without any background development were obtained with stability even after continuous printing of 10,000 sheets.

observing the blade 66 after continuous printing, there was not any scraping in the portion Q of the wire 66A of the blade 66 pressed against the development roller 4.

While the radius of the wire 66A is 0.2 mm in the sixth embodiment, it is preferable that the radius of the wire 66A be 0.1 mm to 0.5 mm. When the radius of the wire 66A is larger than 0.5 mm, to obtain a toner thin layer, it is necessary to increase the force of the wire 66A to press on the toner 1 when the layer is formed, so that the toner 1 easily coheres and the granularity is deteriorated according to the toner 1. In that case, it sometimes occurred that the toner 1 adhered to the wire 66A due to change over time and streaks were generated on images. On the contrary, when the radius of the wire 66A was smaller than 0.1 mm, the toner reservoir in the opposed portion R in the upstream side of the wire 66A in the rotation direction of the development roller 4 was extremely narrow, so that the configuration of the toner reservoir was not stabilized and image formation was unstable.

In the developing apparatus of the sixth embodiment, it is preferable that the surface roughness Ra of the pressed surface q of the wire 66A pressed against the development roller 4 be 0.1 μm or more. The results were particularly excellent when the surface roughness Ra was 0.3 to 1.0 μm. By increasing the surface roughness of the pressed surface q of the wire 66A, the toner 1 is sufficiently stirred when it passes the portion where the blade 66 is pressed against the development roller 4. Consequently, even when the toner 1 is deteriorated due to change over time, the toner 1 can be charged with stability. According to the developing apparatus of the sixth embodiment, sharp images without any background development were obtained with stability. When the surface roughness Ra was less than 0.1 μm, the toner 1 was hardly stirred when it passed the portion where the blade 66 was pressed against the development roller 4, so that background development was generated according to the toner 1 as the toner 1 was deteriorated due to change over time. Methods of increasing the surface roughness of the pressed surface q of the wire 66A include a mechanical method such as sandblasting and chemical methods such as etching and plating.

While the blade 66 is at the same potential as the development roller 4 in the developing apparatus of the sixth embodiment, application of a negative voltage to the blade 66 promoted the movement of charges from the blade 66 to the toner 1, so that the amount of charges of the toner 1 increased. Consequently, according to the developing apparatus of the above-described structure, shaper images without any background development were obtained. It is preferable that the DC voltage applied to the blade 66 be −500 V or higher. The obtained images were particularly excellent when the voltage was −50 to −150 V. When the DC voltage applied to the blade 66 was lower than −500 V, a leak was caused between the blade 66 and the development roller 4, which disturbed the layer formation. The above-mentioned values of the DC voltage applied to the blade 66 are relative values to the development roller 4.

In the developing apparatus of the sixth embodiment, by superposing an AC voltage between the blade 66 and the development roller 4, no toner cohesion occurred even when the toner 1 was deteriorated due to change over time, so that uniform images without any background development or density nonuniformity were obtained. In the developing apparatus thus structured, observing the vicinity of the pressed portion Q where the blade 66 was pressed against the development roller 4 at the time of layer formation, it was observed that the toner 1 vibrated violently between the wire 66A and the development roller 4. It is preferable that the amplitude of the AC bias superposed between the blade 66 and the development roller 4 be 100 to 500 V (from 0 to the peak). The results were particularly excellent when the amplitude was 200 to 300 V (from 0 to the peak). It is preferable that the frequency of the AC bias be 200 Hz to 5 kHz. The results were particularly excellent when the frequency was 500 Hz to 1.5 kHz.

According to an experiment by the inventors, when the amplitude of the AC bias superposed between the blade 66 and the development roller 4 was higher than 500 V (from 0 to the peak), a leak was caused, so that layer formation was disturbed. When the frequency of the AC bias was lower than 200 Hz, the pitch of shades of layer formation due to the reciprocating motion of the toner 1 was conspicuous. When the frequency was higher than 5 kH, the toner 1 did not follow the frequency and the superposition of the AC bias produced hardly any effects.

While the wire 66A is made of a stainless steel plate in the developing apparatus of the sixth embodiment, the present invention is not limited thereto; the wire 66A may be made of a different material such as a different metal, a rubber or a synthetic resin.

While non-magnetic toner is used in the developing apparatus of the sixth embodiment, magnetic toner may be used. However, when magnetic toner was used, slight scraping was found on the wire 66A after continuous printing of 10,000 sheets, so that fine streaks appeared on halftone images.

While a contact phenomenon is used between the development roller 4 and the organic photoconductor in the developing apparatus of the sixth embodiment, a non-contact phenomenon may be used. Moreover, the voltage applied to the development roller 4 in the present invention is not limited to a DC voltage; an AC voltage may be superposed.

While in the developing apparatus of the sixth embodiment, the blade 66 disposed vertically to the development roller 4 is pressed against the development roller 4, the present invention is not limited to this structure. Similar effects to those produced by the developing apparatus of the sixth embodiment are produced, for example, when the blade disposed horizontally to the development roller is pressed against the development roller 4.

Seventh Embodiment

Figure 12:
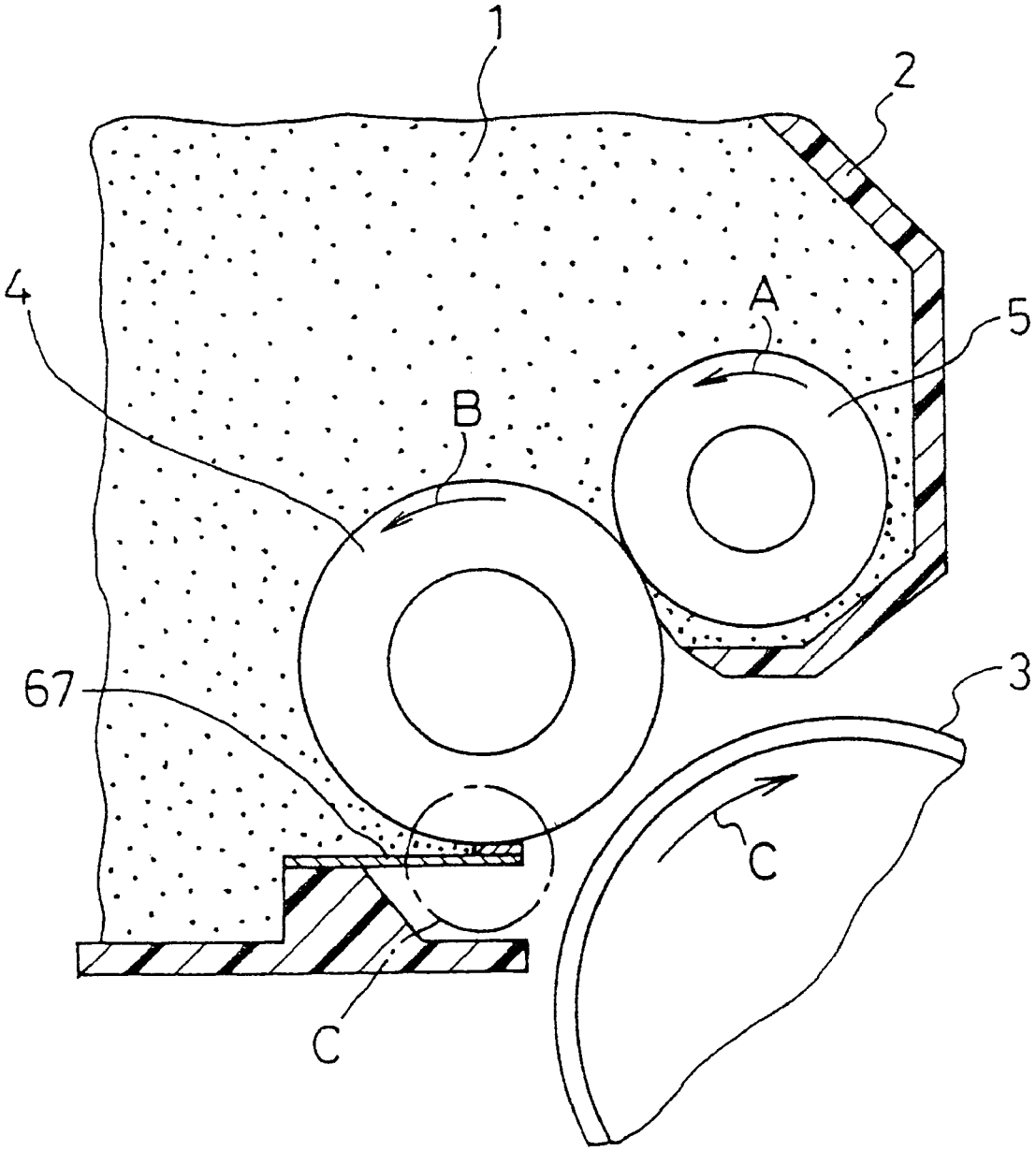
FIG. 12 is an enlarged cross-sectional view showing a portion where a blade is pressed against a development roller and a portion therearound in a seventh embodiment of the present invention.

Hereinafter, a developing apparatus according to a seventh embodiment of the present invention will be described with reference to the accompanying drawings FIG. 12 is a cross-sectional view showing the structure of a relevant part of the developing apparatus according to the seventh embodiment of the present invention. In the developing apparatus of the seventh embodiment, elements and portions having the same functions and structures as the developing apparatuses of the above-described first to sixth embodiments are designated by the same reference numerals and the description thereof is omitted.

In the developing apparatus of the seventh embodiment shown in FIG. 12, non-magnetic single-component magenta toner 1 serving as developer is contained in the development hopper 2, and is supplied to the development roller 4 by the rotation of the supply roller 5 in the direction of the arrow A. The supply roller 5 has a cylindrical shape whose outer surface is made of a urethane foam material. The development roller 4 used in the seventh embodiment has a cylindrical shape with a diameter of 18 mm, and silicone rubber of low hardness (a JIS-A hardness of 46 degrees) with a thickness of 0.5 mm is bonded to the outer surface thereof. Specifications of the development roller 4 are such that the electrical resistance is $10^4\Omega$ and the surface roughness (Ra) is 0.4 $\mu$m. The electrical resistance is obtained in the following manner: The development roller 4 is placed on a chrome-plated iron plate, and under a condition where the development roller 4 presses on the iron plate with its deadweight, a voltage of 5 V is applied between the shaft of the development roller 4 and the plate, and the electrical resistance is obtained from the current value after ten seconds. In the seventh embodiment, the development roller 4 rotates in the direction of the arrow B at a circumferential velocity of 105 mm/s. To the development roller 4, a DC voltage of −200 V to which a sinusoidal AC bias of 750 V (from 0 to the peak) and a frequency of 2 kHz is superposed is applied by a developing bias source (not shown).

As shown in FIG. 12, the organic photoconductor 3 having a cylindrical shape with a diameter of 30 mm and disposed so as to be opposed to the development roller 4 with a distance of 150 $\mu$m therebetween is a laminated organic photoconductor with phthalocyanine as the base. The organic photoconductor 3 of the seventh embodiment rotates in the direction of the arrow C at a circumferential velocity of 105 mm/s.

In the vicinity of the development roller 4 is provided a blade 67 serving as a developer regulating member for regulating the thickness of the layer of the toner 1 on the development roller 4. The blade 67 is fixed to a wall of the development hopper 2 and is at the same potential as the development roller 4

Figure 13:
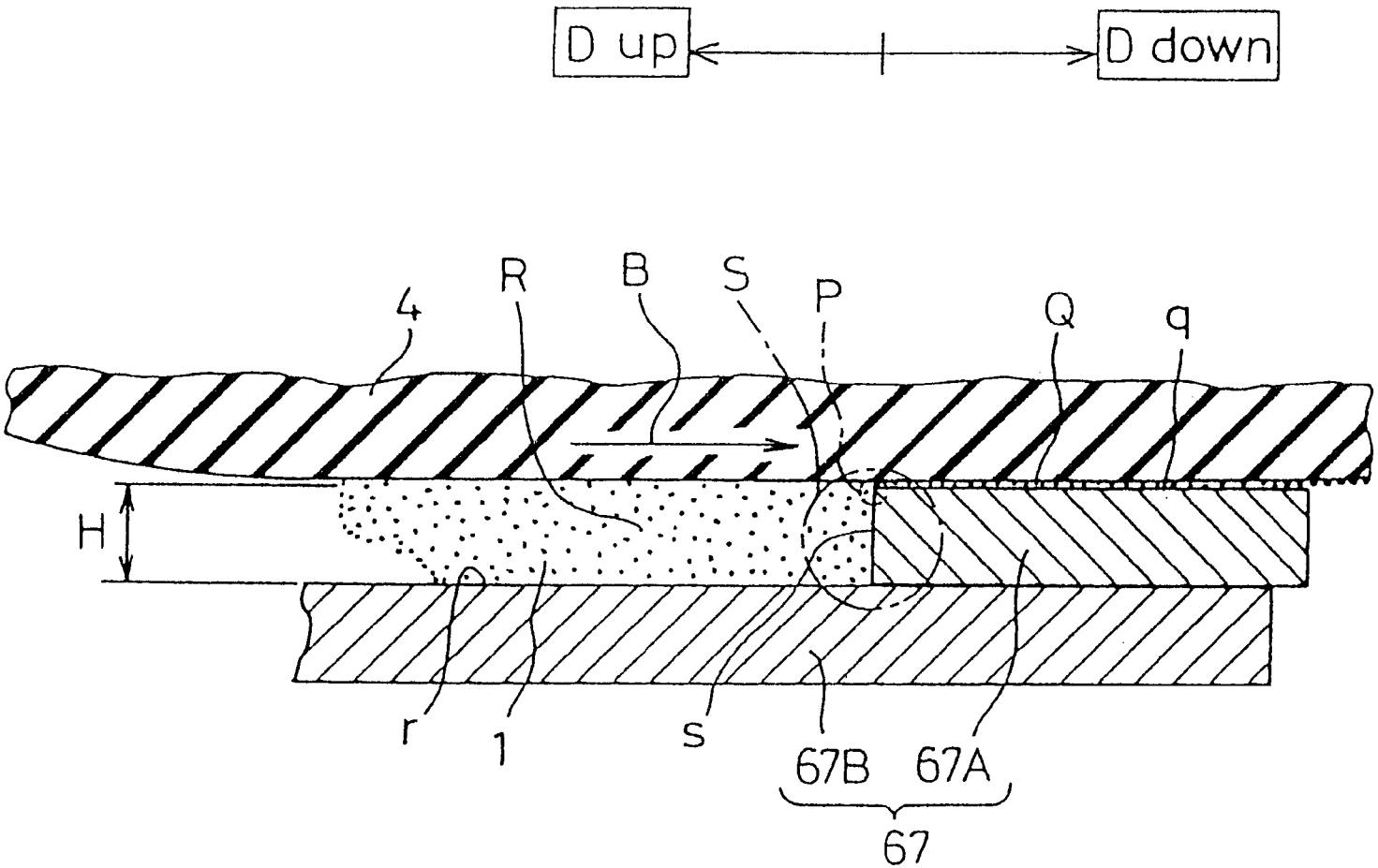
FIG. 13 is an enlarged cross-sectional view showing a portion where a blade is pressed against a development roller and a portion therearound which view shows another example in the developing apparatus of the present invention.

FIG. 13 is an enlarged cross-sectional view showing a portion where the blade 67 serving as the developer regulating member is pressed against the development roller 4 and a portion therearound (the portion shown in C in FIG. 12). As shown in FIG. 13, the blade 67 comprises a first blade plate 67A and a second blade plate 67B bonded together so as to overlap each other. The first blade plate 67A is made of a plate of stainless steel (SUS304) with a thickness of 150 $\mu$m, and the second blade plate 67B is made of a plate of stainless steel (SUS304) with a thickness of 150 $\mu$m. In the blade 67 comprising the first blade plate 67A and the second blade plate 67B bonded together, a step S is formed at an end of the first blade plate 67A. The height H of the step S is 150 $\mu$m. The surface s constituting the step S is substantially vertical to the pressed surface of the development roller 4.

When the toner 1 adhering to the development roller 4 is regulated to a predetermined layer thickness by the blade 67 serving as the developer regulating member, the toner 1 starts to be pressed by the development roller 4 at the edge P of the first blade plate 67A where the plate 67A starts to be in contact with the development roller 4.

In the upstream side (D up) of the step S in the rotation direction of the development roller 4 (the direction of the arrow B in FIG. 13), the second blade plate 67B and the development roller 4 are opposed to each other with a predetermined space therebetween. The surface r of the blade 67 opposed to the development roller 4 is substantially parallel to the pressed surface of the development roller 4.

In the downstream side (D down) of the step S in the rotation direction of the development roller 4 (the direction of the arrow B), the first blade plate 67A is pressed against the development roller 4.

The toner 1 used in the developing apparatus of the seventh embodiment is non-magnetic single-component magenta toner formed in the following manner: Five percent by weight of azo pigment serving as colorant and three percent by weight of a charge control material are kneaded and dispersed in 92 percent by weight of polyester resin. This is crushed and classified. Then, to 99.0 percent by weight of the obtained non-magnetic toner base particles with an average diameter of 6.5 $\mu$m, 1.0 percent by weight of hydrophobic silica serving as a surface reformer is externally added (mixed).

The operation of the developing apparatus of the seventh embodiment thus structured will be described with reference to FIGS. 12 and 13.

The toner 1 in the development hopper 2 is supplied to the surface of the development roller 4 by the rotation of the supply roller 5 in the direction of the arrow A. The supplied toner 1 is conveyed to the position of pressing by the blade 67 by the rotation of the development roller 4 in the direction of the arrow B. The toner 1 conveyed to the position of the development roller 4 pressed by the blade 67 is regulated to a desired layer thickness by the blade 67. By the blade 67, a uniform toner thin layer is formed on the development roller 4.

The organic photoconductor 3 opposed to the development roller 4 is charged to −700 V by a charger (not shown).

By irradiating the organic photoconductor 3 with an exposure signal (not shown) comprising laser, an electrostatic latent image is formed. When an electrostatic latent image is formed in this manner, in the seventh embodiment, the total exposure potential of the organic photoconductor 3 is −100 V. In the seventh embodiment, a DC voltage of −200 V to which a sinusoidal AC bias of 750 V (from 0 to the peak) and a frequency of 2 kHz is superposed is applied to the development roller 4 by a developing bias source (not shown).

In the developing apparatus of the seventh embodiment, the development roller 4 carrying the thin layer of the non-magnetic single-component toner 1 is opposed to the organic photoconductor 3 rotating substantially in the same direction and at the same velocity as the development roller 4 with a distance of 150 $\mu$m therebetween. On the organic photoconductor 3 thus disposed, a toner image in which only the image part is negative-positive reversed is formed.

Observing the vicinity of the pressed portion of the regulated toner layer with the blade 67 being detached, the opposed portion R where the second blade plate 67B and the development roller 4 were opposed to each other in the upstream side (D up) of the step S was filled with the toner 1.

In the pressed portion Q in the downstream side (D down) of the step S, a toner layer was thinly formed so as to have a thickness of approximately 1.2 mm from the edge P of the first blade plate 67A. It is conjectured that the toner 1 is pressed by the development roller 4 and the blade 67 in the pressed portion Q.

The images obtained by use of the toner layer thus formed were always stable in maximum image density, and even after 15,000 sheets were continuously printed, high-quality images without any background development were obtained with stability. Moreover, the toner layer on the development roller 4 had an extremely uniform thickness; no streaks due to the toner adhesion are generated and a toner layer being entirely thin and uniform was formed.

Observing the toner layer after continuous printing with the blade 67 being detached, there was not any scraping of the toner 1 in the portion pressed by the edge P of the first blade plate 67A or in the portion Q pressed by the development roller 4 and the first blade plate 67A.

While the thickness of the first blade plate 67A, that is, the height H of the step S is 150 $\mu$m in the developing apparatus of the seventh embodiment, in the developing apparatus of the present invention, a preferred toner layer is formed when the height H of the step S is 2 mm or smaller. Particularly, when the height H is 0.5 mm or smaller, a uniform toner thin layer is surely formed.

According to an experiment by the inventors, when the thickness H of the first blade plate 67A was larger than 2 mm, the pressure applied to the toner 1 was low in the toner reservoir in the opposed portion R where the second blade plate 67B and the development roller 4 were opposed to each other. Consequently, the toner thin layer was extremely thin and nonuniform.

Figure 14:
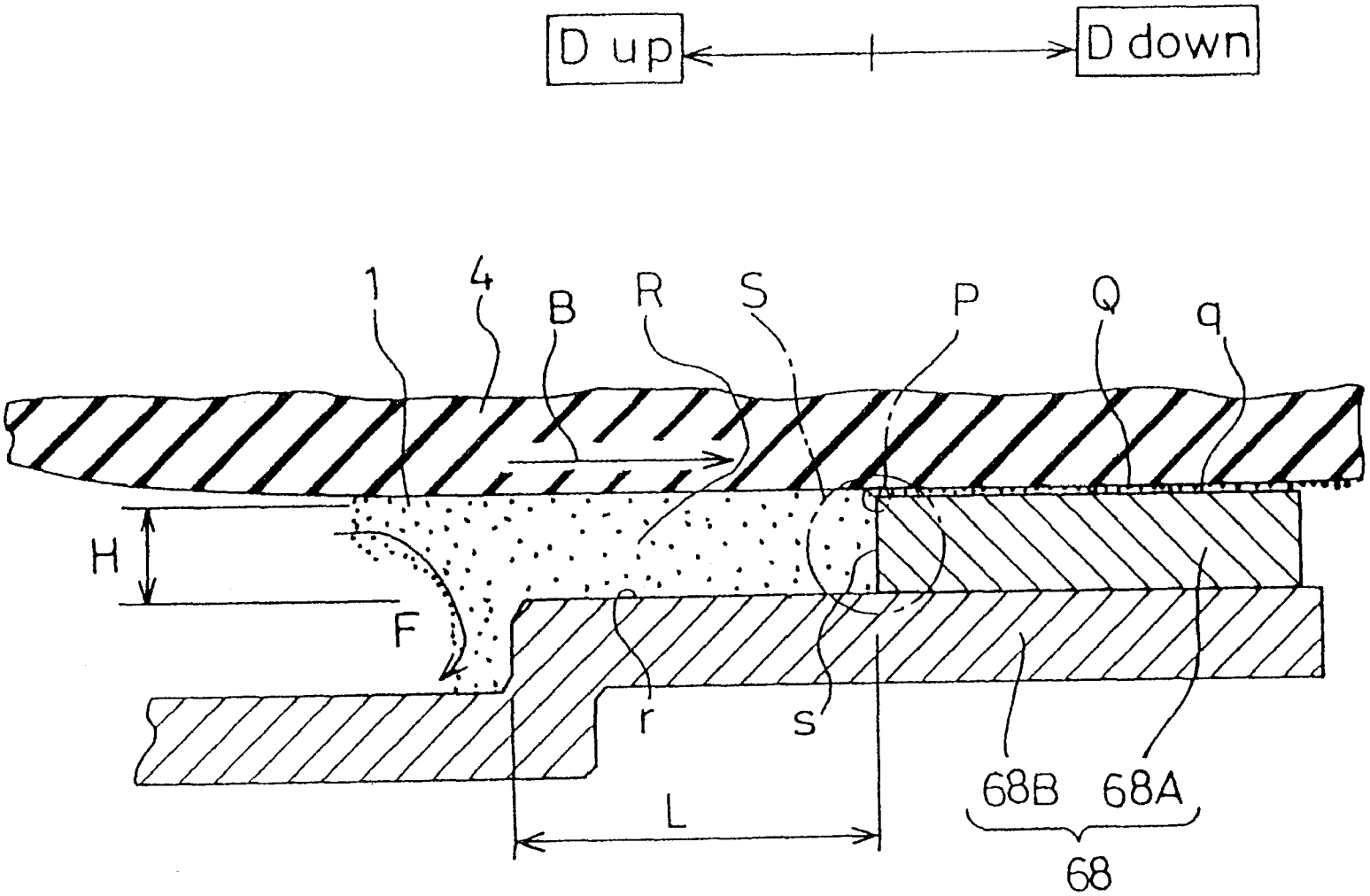
FIG. 14 is an enlarged cross-sectional view showing a portion where a blade is pressed against a development roller and a portion therearound which view shows another example in the developing apparatus of the present invention.
Figure 15:
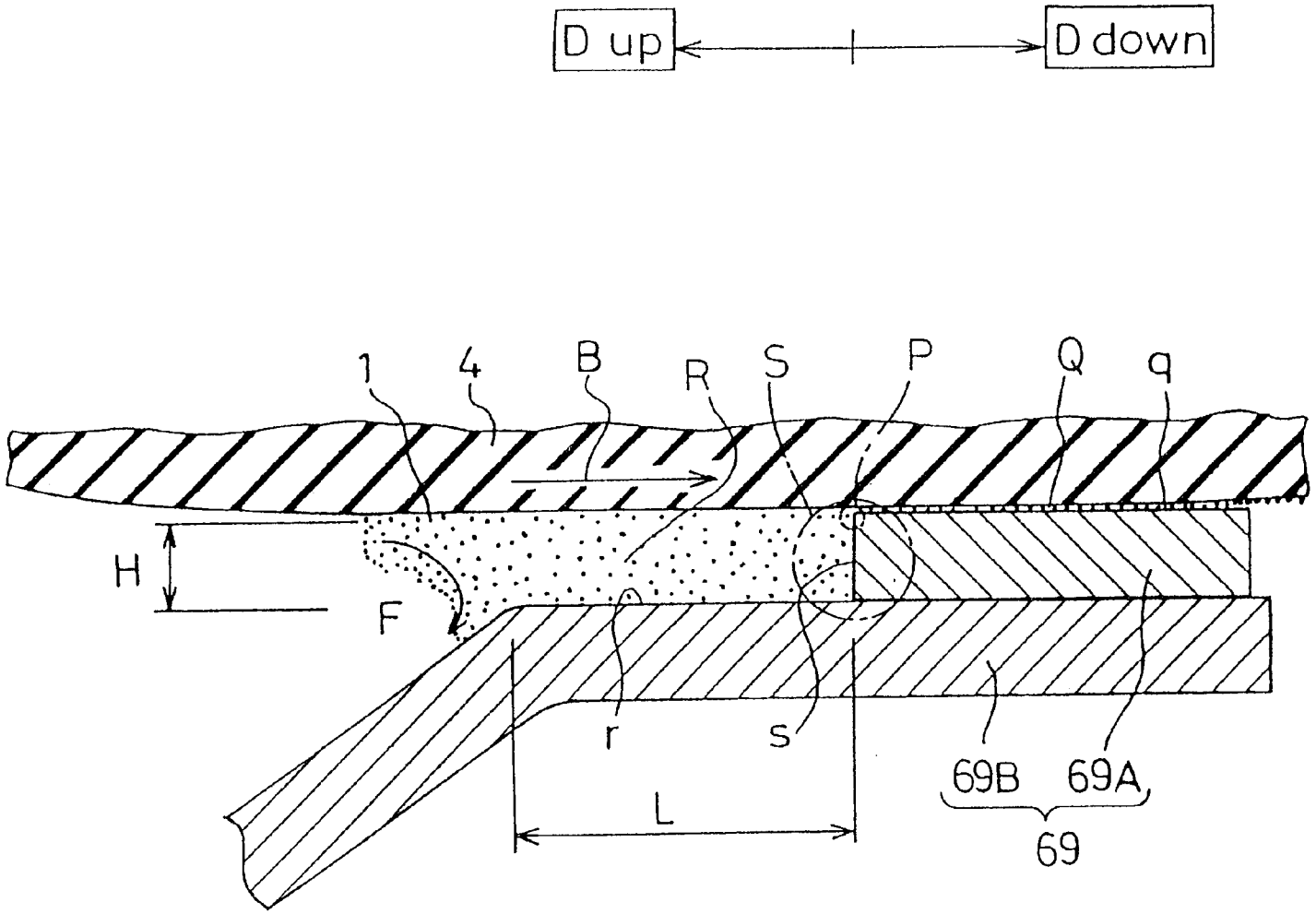
FIG. 15 is an enlarged cross-sectional view showing a portion where a blade is pressed against a development roller and a portion therearound which view shows another example in the developing apparatus of the present invention.

While in the seventh embodiment, the blade 67 is formed by bonding together the first blade plate 67A and the second blade plate 67B both of which are plates as shown in FIG. 13, the blade may be formed as shown in FIGS. 14 or 15. FIG. 14 is an enlarged cross-sectional view showing a portion where a blade 68 is pressed against the development roller 4 and a portion therearound. FIG. 15 is an enlarged cross-sectional view showing a portion where a blade 69 is pressed against the development roller 4 and a portion therearound.

As shown in FIG. 14, the blade 68 is formed by bonding a first blade plate 68A to a second blade plate 68B. The second blade plate 68B is stepwisely bent outward at a position 1 mm away from the edge P of the first blade plate 68A in the upstream side (D up) in the rotation direction of the development roller 4.

As shown in FIG. 15, the blade 69 is formed by bonding a first blade plate 69A to a second blade plate 69B. The second blade plate 69B is obliquely bent outward at the same position as the second blade plate 68B shown in FIG. 14 is bent, that is, at the position 1 mm away from the edge P in the upstream side (D up).

As shown in FIGS. 14 and 15, by bending the second blade plates 68B and 69B, the pressure applied to the toner in the toner reservoir in the opposed portion R where the second blade plates 68B and 69B are pressed against the development roller 4 is reduced and stabilized. Consequently, in the developing apparatus thus structured, even when toner having an inferior mobility like small-diameter toner is used, it never occurs that the toner excessively accumulates in the toner reservoir due to change over time, so that a stable toner thin layer can be formed with a lower torque.

At the time of toner layer regulation in the developing apparatus thus structured, observing the vicinity of the portion where the blades 68 and 69 were pressed against the development roller 4, in the upstream side (D up), in the rotation direction of the development roller 3, of the opposed portion R where the second blade plates 68B and 69B were opposed to the development roller 4, much of the toner 1 conveyed by the development roller moved in the direction of the arrow F.

While the second blade plates 68B and 69B shown in FIGS. 14 and 15 are bent outward at the position 1 mm away from the edge P in the upstream side (D up), it is preferable that the distance L from the edge P to the bent position be 0.2 mm or larger. The results were particularly excellent when the distance L was 0.5 to 3 mm.

When the distance L from the edge P was smaller than 0.2 mm, the pressure applied to the toner in the toner reservoir in the opposed portion R was low, so that the toner layer was extremely thin and layer formation was unstable.

However, even when the distance L from the edge P was within the above-mentioned appropriate range, when the heights H of the first blades 68A and 69B were larger than the length L of the portion where the second blade plates 68B and 69B were opposed to the development roller 4, the pressure applied to the toner in the toner reservoir in the opposed portion was low according to the toner 1, so that the toner thin layer was extremely thin and layer formation was unstable.

Figure 16:
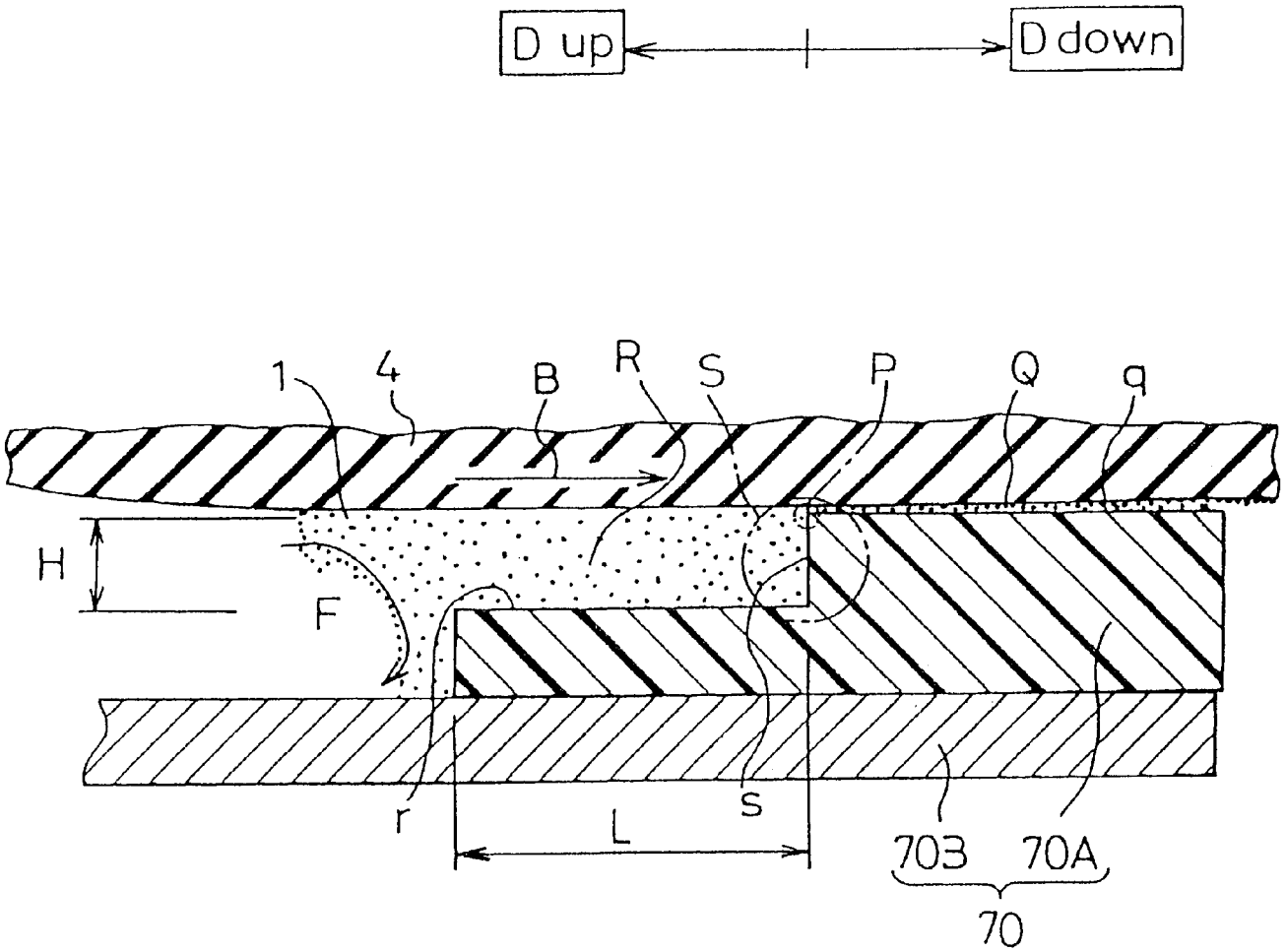
FIG. 16 is an enlarged cross-sectional view showing a portion where a blade is pressed against a development roller and a portion therearound which view shows another example in the developing apparatus of the present invention.

While the blade in the developing apparatus of the seventh embodiment comprises two stainless steel plates bonded together, a blade 70 may be formed by bonding to a second blade plate 70B a first blade plate 70A serving as a step forming member made of rubber or synthetic resin molded into a stepped configuration as shown in FIG. 16. FIG. 16 is an enlarged cross-sectional view showing a portion where the blade 70 is pressed against the development roller 4 and a portion therearound. By being provided with a configuration substantially the same as that of the above-described blade 68 of FIG. 14, the blade 70 shown in FIG. 16 produces similar effects to the blade 68 of FIG. 14. By being provided with a configuration similar to that of the second blade plate 69B shown in FIG. 15, the second blade plate 70B shown in FIG. 16 produces similar effects to the blade 69 shown in FIG. 15.

Figure 17:
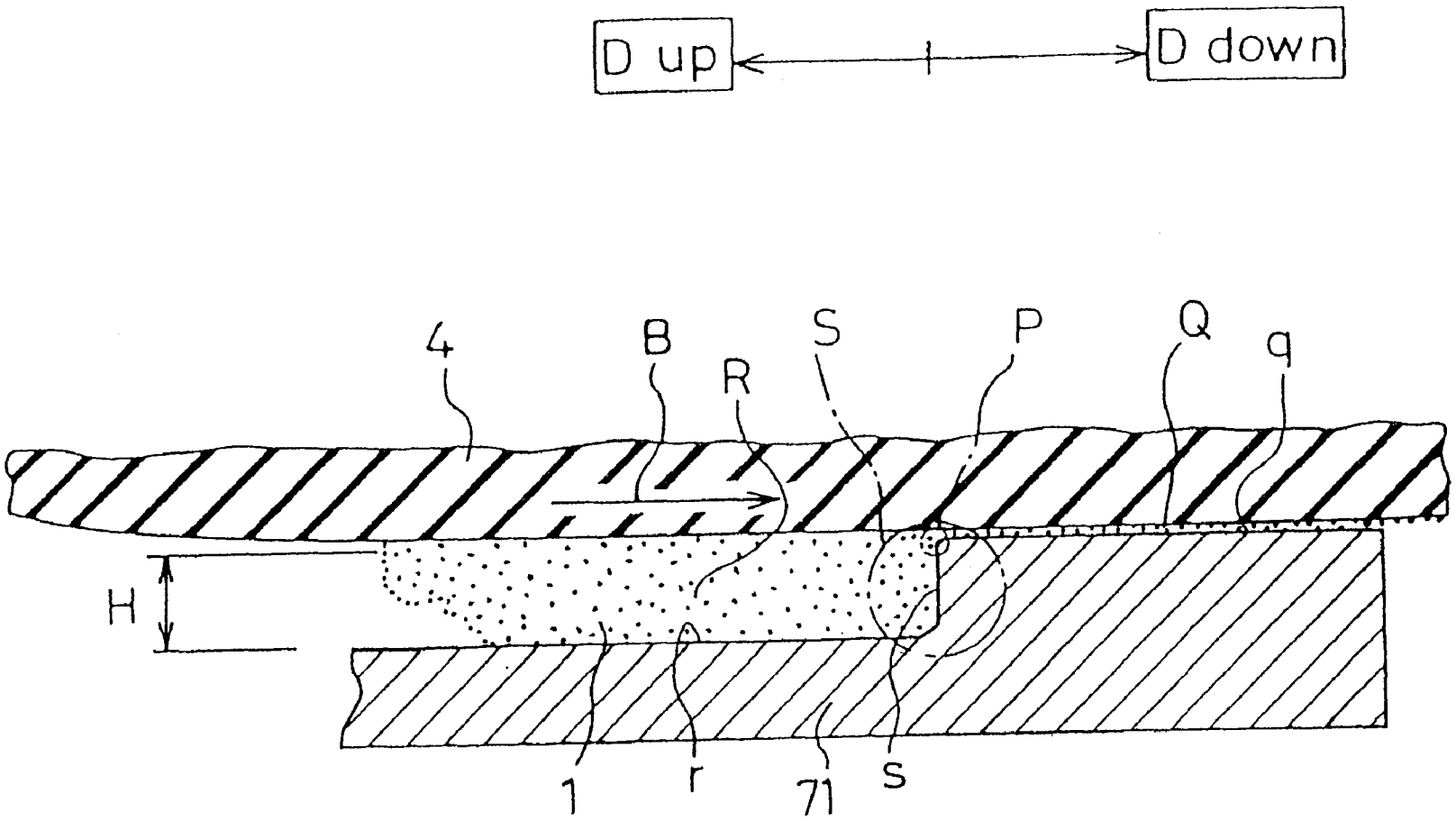
FIG. 17 is an enlarged cross-sectional view showing a portion where a blade is pressed against a development roller and a portion therearound which view shows another example in the developing apparatus of the present invention.

FIG. 17 is an enlarged cross-sectional view showing a portion where a blade 71 is pressed against the development roller 4 and a portion therearound which view shows another example in the developing apparatus of the present invention.

As shown in FIG. 17, a blade 71 comprises one stainless steel plate processed into a desired configuration by forming a step by chemical processing such as etching or by machining. The developing apparatus using the blade 71 thus processed produces similar effects to the above-described developing apparatus shown in FIG. 13 in the portion where the blade 71 is pressed against the development roller 4 and in the vicinity of the toner reservoir which is in front of the pressed portion. According to an experiment by the inventors, a developing apparatus using a blade processed into the same configuration as that of the blade shown in FIGS. 14 or 15 by chemical processing such as etching or by machining also produced similar effects to the above-described developing apparatus shown in FIGS. 14 or 15.

Figure 18:
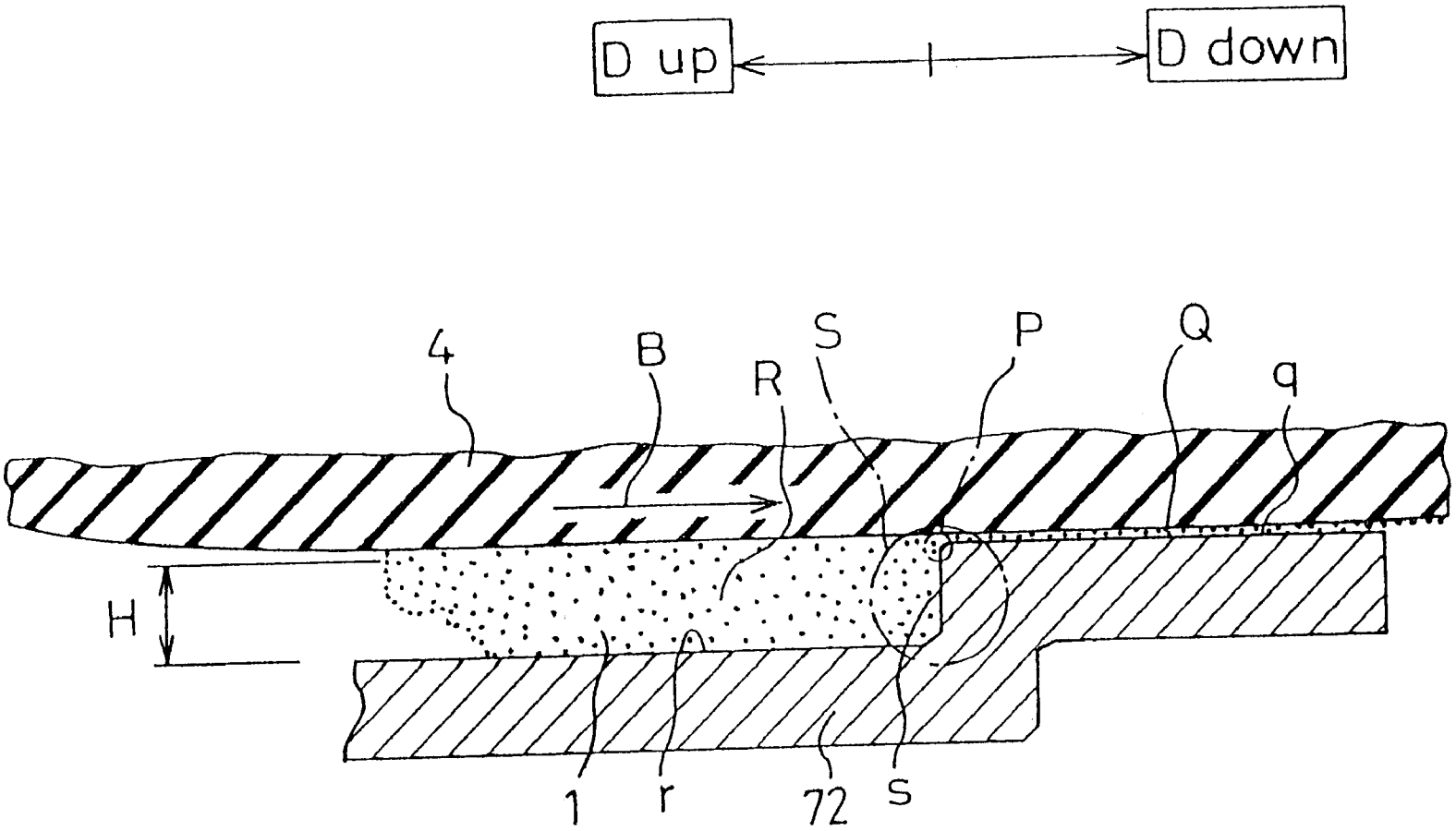
FIG. 18 is an enlarged cross-sectional view showing a portion where a blade is pressed against a development roller and a portion therearound which view shows another example in the developing apparatus of the present invention.

FIG. 18 is an enlarged cross-sectional view showing a portion where a blade 72 is pressed against the development roller 4 and a portion therearound which view shows another example in the developing apparatus of the present invention.

The blade 72 shown in FIG. 18 comprises one stainless steel plate with its end bent in a crank shape. By thus forming the blade 72 of one stainless plate, the blade 72 can be easily and inexpensively manufactured. The developing apparatus using the blade 72 thus processed produces similar effects to the above-described developing apparatus shown in FIG. 17 in the portion where the blade 72 is pressed against the development roller 4 and in the vicinity of the toner reservoir which is in front of the pressed portion.

According to an experiment by the inventors, a developing apparatus using a blade processed into the same configuration as that of the blade shown in FIGS. 14 or 15 by chemical processing such as etching or machining produced similar effects to the above-described developing apparatus shown in FIGS. 14 or 15.

Figure 19:
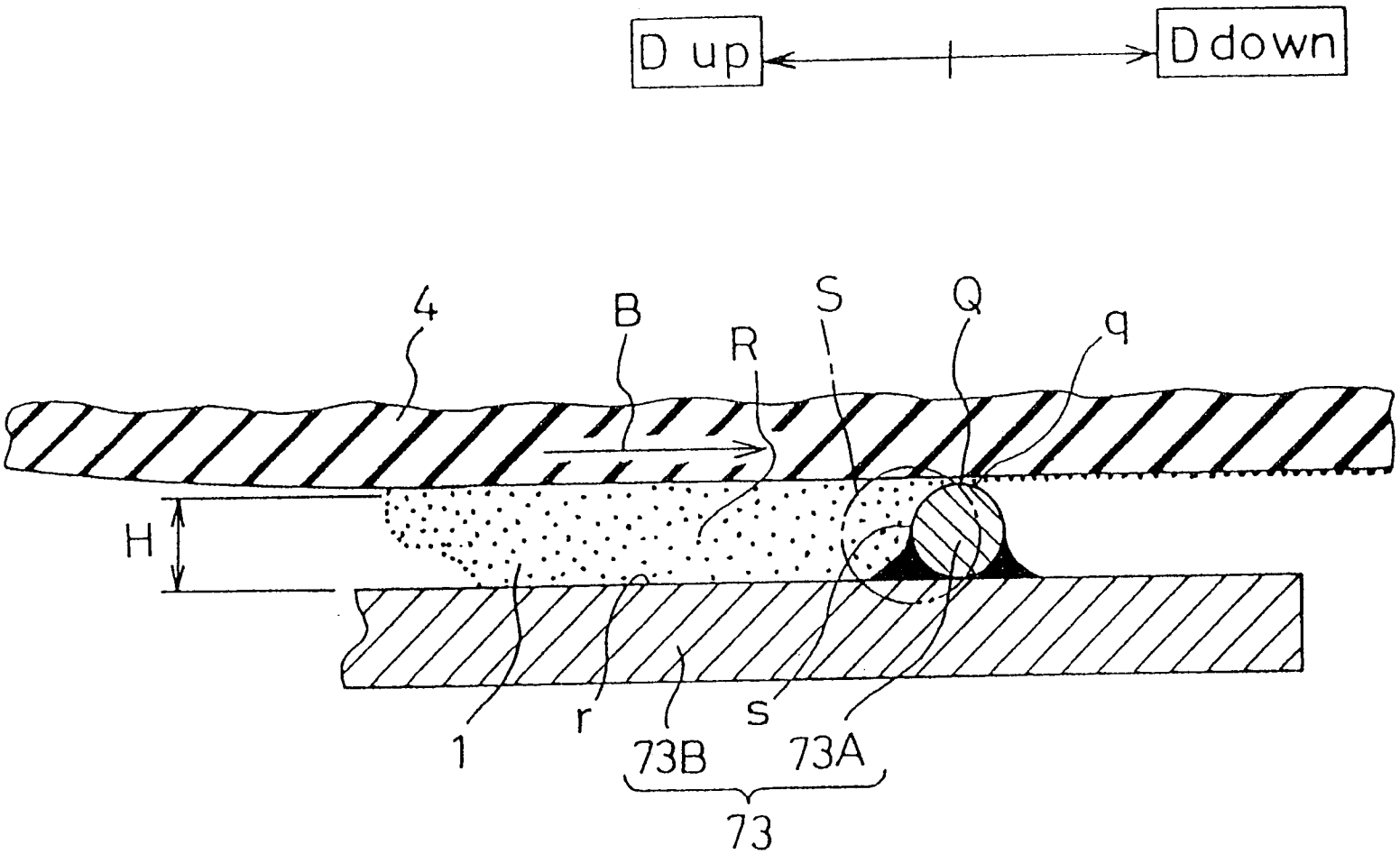
FIG. 19 is an enlarged cross-sectional view showing a portion where a blade is pressed against a development roller and a portion therearound which view shows another example in the developing apparatus of the present invention.
Figure 20:
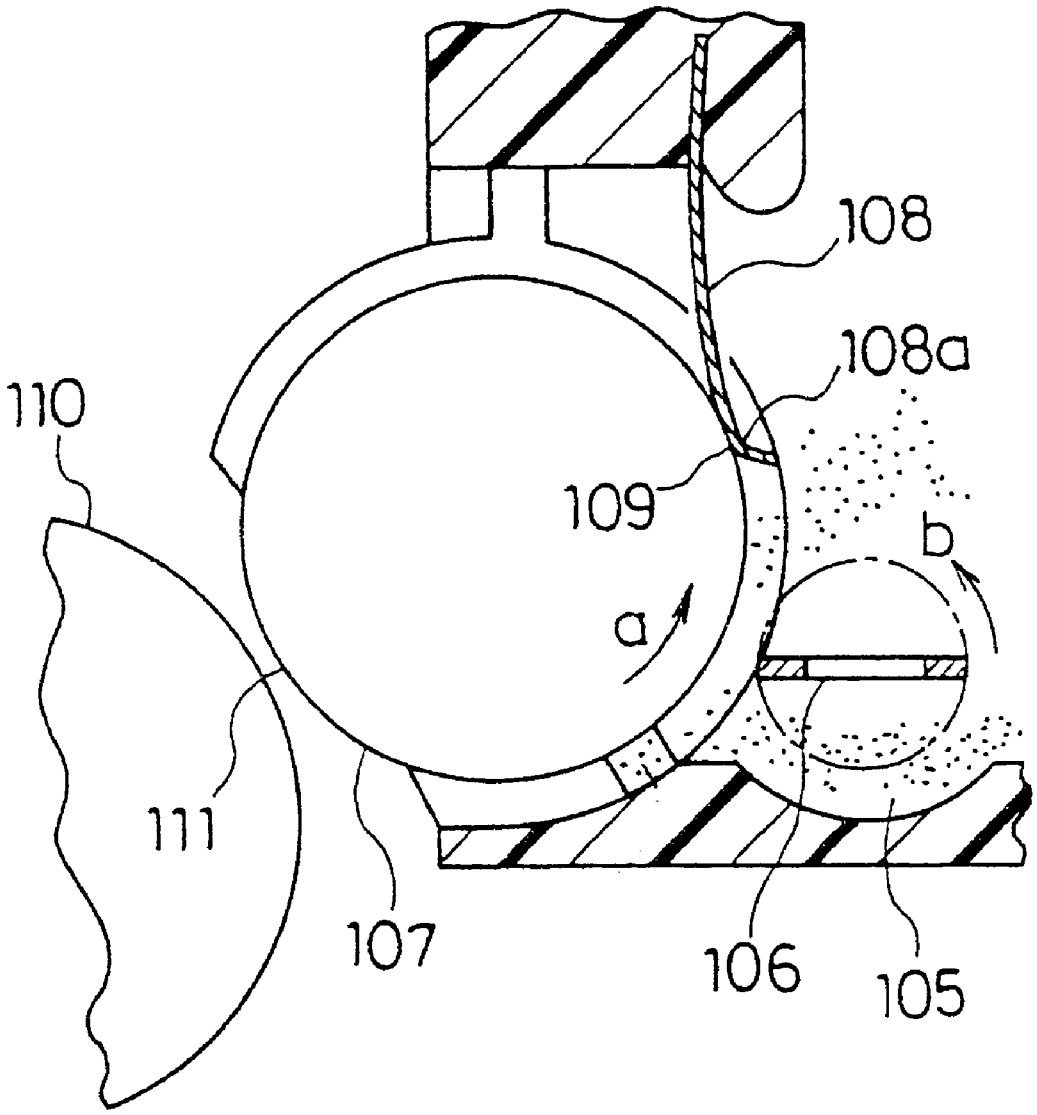
FIG. 20 is the cross-sectional view showing the structure of the relevant part of the conventional developing apparatus.

FIG. 19 is an enlarged cross-sectional view showing a portion where a blade 73 is pressed against the development roller 4 and a portion therearound which view shows another example in the developing apparatus of the present invention.

The blade 73 shown in FIG. 19 is formed by bonding a wire 73A with a radius of 0.2 mm to a second blade plate 73B with a thickness of 150 $\mu$m like the above-described sixth embodiment shown in FIG. 11. The developing apparatus having the blade 73 shown in FIG. 19 produced similar effects to that of the above-described sixth embodiment. In this case, it is preferable that the radius of the wire 73A be 0.1 mm to 0.5 mm.

When the radius of the wire 73A is larger than 0.5 mm, to obtain a toner thin layer, it is necessary to increase the force to press on the toner 1 when the layer is formed, so that the toner 1 easily coheres and the granularity is deteriorated according to the toner 1. Moreover, it sometimes occurred that the toner 1 adhered to the wire 73A due to change over time and streaks were generated on images.

When the radius of the wire 73A was smaller than 0.1 mm, the toner reservoir in the upstream side of the wire 73A was extremely narrow, so that the configuration of the toner reservoir was not stabilized and image formation was unstable.

As described above, according to the developing apparatus of the present invention, the toner thin layer regulating capability and the toner charging capability can be enhanced by the developer regulating member of a simple structure, and the development roller can be rotated with a small driving force, so that toner is prevented from adhering. As a result, development can be performed with high accuracy.

According to the developing apparatus of the present invention, a uniform toner thin layer can be obtained with a low torque by a layer regulating member of a simple structure.

According to the developing apparatus of the present invention, since the toner charging capability is high, sharp high-quality images without any background development can be obtained with stability even when the toner is deteriorated due to change over time.

According to the developing apparatus of the present invention, toner does not easily adhere to the developer regulating member, so that excellent images where streaks are not easily generated due to change over time can be provided.

According to the developing apparatus of the present invention, since the toner reservoir is formed with stability, the pressure applied to the toner immediately before the layer is regulated is uniformized, so that a uniform toner layer can be obtained with stability.

According to the developing apparatus of the present invention, excessive one of the toner conveyed by the rotation of the development roller is removed at the step, so that a uniform toner thin layer can be formed with a low pressure and the development roller can be rotated with a low torque.

According to the developing apparatus of the present invention, it is unnecessary for the developer regulating member to press on the toner against the development roller with a very large force, so that the toner does not easily cohere, images with excellent granularity are obtained and the toner does not easily adhere to the developer regulating member.

According to the developing apparatus of the present invention, the stress on the toner is light, so that toner deterioration is curbed.

According to the developing apparatus of the present invention, since there is a sufficient space in the opposed portion in the upstream side in the rotation direction of the development roller, not all of the pressure applied to the toner conveyed by the rotation of the development roller is directed to the pressed portion but some of the pressure is dissipated. Consequently, the pressure applied to the toner in the toner reservoir is never excessive, so that a toner thin layer being stable over time can be obtained.

According to the developing apparatus manufacturing method of the present invention, the developer regulating member can be easily and accurately formed at low cost, and an image apparatus can be provide that is capable of forming sharp high-quality images.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member has: a surface constituting a step in a rotation direction of said development roller; a pressed surface that is pressed against said development roller in a downstream side of said step; and an opposed surface that is opposed to the outer surface of said development roller with a predetermined space therebetween in an upstream side of said step, said opposed surface being substantially parallel with said outer surface, so that a substantially rectangular space for receiving toner is formed between said opposed surface and said development roller.

2. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member has: a surface constituting a step in a rotation direction of said development roller; a pressed surface that is pressed against said development roller in a downstream side of said step; and an opposed surface that is opposed to the outer surface of said development roller with a predetermined space therebetween in an upstream side of said step the distance between said pressed surface constituted by said step and said opposed surface is H and the length in said opposed surface along a circumference of said development roller is L, $H \leqq 0.7L$ and $H \leqq 2.0$ mm.

3. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member has: a surface constituting a step in a rotation direction of said development roller; a pressed surface that is pressed against said development roller in a downstream side of said step; and an opposed surface that is opposed to the outer surface of said development roller with a space therebetween in an upstream side of said step, and said developer regulating member starts to be pressed against said development roller at an edge formed by said surface constituting said step and said pressed surface.

4. A developing apparatus comprising:

a development roller holding developer on an outer surface thereof, said development roller rotating; and a developer regulating member being pressed against the outer surface of said development roller to relate the developer on said development roller to a predetermined layer thickness, said development roller carrying unregulated developer from an upstream location, past said developer regulating member to a downstream location, wherein said developer regulating member has: a surface constituting a step in a rotation direction of said development roller; a pressed surface that is pressed against said development roller in a downstream side of said step; and an opposed surface that is opposed to the outer surface of said development roller with a predetermined space therebetween in an upstream side of said step, and said developer regulating member has a second opposed surface having a second step formed in the downstream side of said pressed surface, said second opposed surface being opposed to said development roller with a predetermined space therebetween.

5. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member comprises a first plate and a second plate overlapping each other, the thickness of said first plate is 2 mm or smaller and said developer regulating member has a step in a rotation direction of said development roller, wherein said first plate has a pressed surface that is pressed against said development roller in a downstream side of said step, and wherein said second plate has an opposed surface that is opposed to the outer surface of said development roller with a predetermined space therebetween in an upstream side of said step.

6. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member comprises a first plate and a second plate overlapping each other, and has a step in a rotation direction of said development roller, said first plate is made of a conductive material, and voltage generating means is provided for applying a DC voltage and an AC voltage to said first plate, wherein said first plate has a pressed surface that is pressed against said development roller in a downstream side of said step, and wherein said second plate has an opposed surface that is opposed to the outer surface of said development roller with a predetermined space therebetween in an upstream side of said step.

7. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member comprises a first plate and a second plate overlapping each other, and has a step in a rotation direction of said development roller, said second plate is made of a conductive material, and voltage generating means is provided for applying a DC voltage and an AC voltage to said second plate, wherein said first plate has a pressed surface that is pressed against said development roller in a downstream side of said step, and wherein said second plate has an opposed surface that is opposed to the outer surface of said development roller with a predetermined space therebetween in an upstream side of said step.

8. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member comprises a first plate and a second plate overlapping each other, and has a step in a rotation direction of said development roller, and an end of at least one of said first plate and said second plate is supported in a downstream side in a rotation direction of said development roller, wherein said first plate has a pressed surface that is pressed against said development roller in the downstream side of said step, and wherein said second plate protrudes from said first plate in an upstream side of said step, and has an opposed surface that is opposed to the outer surface of said development roller with a predetermined space therebetween.

9. A developing apparatus in accordance with claim 8, wherein a length of a portion of said second plate protruding from said first plate in the upstream side in the rotation direction of said development roller is larger than a thickness of said first plate.

10. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member has an elastic member made of an elastic material, and a step forming member being pressed against said development roller by elasticity of said elastic member, said step forming member having a step in a rotation direction of said development roller, and wherein said step forming member has a pressed surface that is pressed against said development roller in a downstream side of said step, and an opposed surface that is opposed to the outer surface of said development roller with a predetermined space therebetween in an upstream side of said step.

11. A developing apparatus in accordance with claim 10, wherein said step forming member is made of an elastic material.

12. A developing apparatus in accordance with claim 10, wherein said elastic member and said step forming member are integral with each other.

13. A developing apparatus comprising:

a development roller holding developer on an outer surface thereof, said development roller rotating; and a developer regulating member being pressed against the outer surface of said development roller to regulate the developer on said development roller to a predetermined layer thickness, said development roller carrying unregulated developer from an upstream location, past said developer regulating member to a downstream location, wherein said developer regulating member has: a surface constituting a step in a rotation direction of said development roller; a pressed surface that is pressed against said development roller in a downstream side of said step; and an opposed surface that is opposed to the outer surface of said development roller with a predetermined space therebetween in an upstream side of said step, and a portion of toner moved by rotating said development roller is separated from said development roller in an upstream side in the rotation direction of said development roller in said predetermined space, and a remaining portion of said toner is filled into said predetermined space.

14. A developing apparatus comprising:

a development roller holding developer on an outer surface thereof, said development roller rotating; and a developer regulating member having a first member and a second member, said development roller carrying unregulated developer from an upstream location, past said developer regulating member to a downstream location, wherein one end part of said first member is fixed to an apparatus housing, and the other end part thereof has a pressed surface which is pressed against the outer surface of said development roller to regulate the developer on said development roller to a predetermined layer thickness and said second member is connected with said first member, arranged to have a substantially rectangular space from said development roller, extended to an upstream side in a rotation direction of said development roller.

* * * * *